US011139624B2

(12) United States Patent
Miyamura et al.

(10) Patent No.: US 11,139,624 B2
(45) Date of Patent: Oct. 5, 2021

(54) TWISTED PAIR CABLE JOINT CONNECTOR

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventors: Tetsuya Miyamura, Mie (JP); Yasuo Omori, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 467 days.

(21) Appl. No.: 16/323,312

(22) PCT Filed: Aug. 8, 2017

(86) PCT No.: PCT/JP2017/028701
§ 371 (c)(1),
(2) Date: Feb. 5, 2019

(87) PCT Pub. No.: WO2018/037904
PCT Pub. Date: Mar. 1, 2018

(65) Prior Publication Data

US 2021/0281032 A1 Sep. 9, 2021

(30) Foreign Application Priority Data

Aug. 25, 2016 (JP) ..... JP2016-164399

(51) Int. Cl.
*H01R 31/08* (2006.01)
*H01R 13/436* (2006.01)
*H01R 13/518* (2006.01)

(52) U.S. Cl.
CPC ..... *H01R 31/08* (2013.01); *H01R 13/436* (2013.01); *H01R 13/518* (2013.01)

(58) Field of Classification Search
None
See application file for complete search history.

(56) References Cited

U.S. PATENT DOCUMENTS 5,122,077 A 6/1992 Maejima et al.
6,120,332 A * 9/2000 Bertens ..... H01R 13/514 439/701

(Continued)

FOREIGN PATENT DOCUMENTS

JP 2-148583 6/1990
JP 2003-346968 12/2003

(Continued)

OTHER PUBLICATIONS

International Search Report dated Oct. 31, 2017.

*Primary Examiner* — Ross N Gushi
(74) *Attorney, Agent, or Firm* — Gerald E. Hespos; Michael J. Porco; Matthew T. Hespos

(57) ABSTRACT

A joint connector includes high and low potential wire terminals (10H, 10L), a plurality of sub-housings (20A, . . . ) corresponding to the respective twisted pair cables and configured to hold the high and low potential wire terminals (10H, 10L), a main housing (30) configured to accommodate the sub-housings (20A, . . . ) in a stacked state, high and low potential connection conductors (40H, 40L) configured to connect the high potential wire terminals (10H) to each other and connect the low potential wire terminals (10L) to each other, and a holding member (50) including housing restraining portions (54) and to be mounted into the main housing (30) such that the housing restraining portions cross the sub-housings (20A, . . . ). The housing restraining portions (54) restrain restrained portions of the sub-housings (20A, . . . ) to impede the withdrawal of the sub-housings (20A, . . . ) in a direction opposite to a housing insertion direction.

12 Claims, 23 Drawing Sheets

(56) References Cited

U.S. PATENT DOCUMENTS 6,149,447 A * 11/2000 Maeda ..... B63B 22/04 439/157
6,241,539 B1 * 6/2001 Sato ..... H01R 13/193 439/157
6,786,777 B2 * 9/2004 Sakatani ..... H01R 13/64 439/677
6,840,820 B2 * 1/2005 Oda ..... H01R 13/518 439/721
6,857,912 B2 * 2/2005 Wu ..... H01R 12/772 439/701
7,306,486 B2 * 12/2007 Takeda ..... H01R 13/4223 439/352
7,354,318 B2 * 4/2008 Murakami ..... H01R 4/185 439/701
7,364,449 B2 * 4/2008 Makino ..... H01R 9/226 439/212
7,377,824 B2 * 5/2008 Mizutani ..... H01R 13/4223 439/752
7,572,154 B2 * 8/2009 Ichio ..... H01R 13/4361 361/735
7,594,830 B2 * 9/2009 Murakami ..... H01R 4/185 439/701
7,955,127 B2 * 6/2011 Sakamoto ..... H01R 13/521 439/587
8,915,758 B2 * 12/2014 Shishikura ..... H01R 13/514 439/701
9,214,775 B2 * 12/2015 Watanabe ..... H01R 31/08
10,205,264 B2 * 2/2019 Washio ..... H01R 13/518
2003/0236032 A1 12/2003 Sakatani
2009/0042445 A1 2/2009 Ichio et al.

FOREIGN PATENT DOCUMENTS

JP 2008-098118 4/2008
JP 2009-043642 2/2009

* cited by examiner

TWISTED PAIR CABLE JOINT CONNECTOR

BACKGROUND

Field of the Invention

The invention relates to a twisted pair cable joint connector used to connect high potential wires and to connect low potential wires of twisted pair cables each including the high potential wire and the low potential wire.

Related Art

A twisted pair cable has excellent resistance to the intrusion of noise from outside due to electromagnetic waves. This twisted pair cable includes two wires twisted together. A high potential signal and a low potential signal are caused to flow in these wires, and necessary information is transmitted by a potential difference between these signals. In this twisted pair cable, even if noise is mixed in each wire, a voltage of each noise is substantially equal and the potential difference between the wires is kept substantially constant. Thus, an influence given to the information being transmitted by the noise is small.

Further, in recent years, a joint connector has been developed for simultaneously and collectively connecting wires for high potential signals and connecting wires for low potential signals of twisted pair cables. For example, Japanese Unexamined Patent Publication No. 2008-98118 discloses a joint connector with connectors (unit connectors) to be mounted respectively on ends of twisted pair cables, a connector housing for holding the connectors, and a busbar to be accommodated into the connector housing. The connectors are accommodated in the connector housing while being arranged in a direction perpendicular to an arrangement direction of the high potential wire and the low potential wire in the twisted pair cables to be connected to the connectors. The busbar is configured to connect the high potential wires and to connect the low potential wires in the respective twisted pair cables. Each of the connectors includes a deflectable lock piece. The lock pieces engage projections of the connector housing to the connectors in the connector housing.

According to this joint connector, the connectors (unit connectors) are equipped to correspond to the respective twisted pair cables. Thus, the twisted pair cables can be mounted into the connector housing and inspected. Therefore, maintenance and the like can be made for each twisted pair cable, and each twisted pair cable is handled easily. In addition, since the connectors (unit connectors) mounted on the ends of the respective twisted pair cables are held in the common connector housing, the high potential wires of the respective twisted pair cables are connected collectively and the low potential wires thereof are connected collectively via the busbar accommodated in the connector housing.

The joint connector described in Japanese Unexamined Patent Publication No. 2008-98118 requires the lock piece to be provided on the housing of each unit connector to enable the connector housing to lock each unit connector. The lock piece needs to project a large distance from an outer surface of the housing by a dimension corresponding to a deflection margin thereof to be deflectable and deformable in a direction parallel to an arrangement direction of the twisted pair cables. This hinders the miniaturization of the unit connectors and the connector housing for holding the unit connectors. The miniaturization and simplification of the lock pieces to suppress such an inconvenience may lead to a shortage of a locking force (holding force) of the unit connectors by the connector housing and, eventually, a reduction of product reliability.

The invention aims to provide a joint connector for connecting high potential wires and connecting low potential wires of twisted pair cables each including the high potential wire and the low potential wire, the joint connector capable of being reduced in size while facilitating the handling of each twisted pair cable and ensuring high product reliability.

SUMMARY

The invention is directed to a joint connector for connecting high potential wires and connecting low potential wires included in twisted pair cables each including the high potential wire and the low potential wire. The joint connector includes high potential wire terminals to be mounted on the respective high potential wires, low potential wires to be mounted on the respective low potential wires, sub-housings respectively corresponding to the twisted pair cables and a main housing. Each sub-housing is configured to hold the high potential wire terminal and the low potential wire terminal of the corresponding twisted pair cable arranged in a specific terminal arrangement direction. The main housing includes a sub-housing insertion opening open in a specific direction. The main housing is configured to accommodate the sub-housings in such an array that the sub-housings are stacked in a housing stacking direction intersecting the terminal arrangement direction by receiving the sub-housings inserted in a housing insertion direction parallel to an axial direction of the high potential wire terminals and the low potential wire terminals through the sub-housing insertion opening. A high potential connection conductor is held in the main housing. The high potential connection conductor includes high potential connection terminals fittable to the high potential wire terminals respectively held in the sub-housings in a direction parallel to the housing insertion direction and a high potential shorting portion for shorting the high potential connection terminals to each other. The high potential connection conductor is configured to connect the high potential wire terminals to each other. A low potential connection conductor also is held in the main housing. The low potential connection conductor includes low potential connection terminals that fit to the low potential wire terminals respectively held in the sub-housings in a direction parallel to the housing insertion direction and a low potential shorting portion for shorting the low potential connection terminals to each other. The low potential connection conductor is configured to connect the low potential wire terminals to each other. A holding member is mounted into the main housing to hold each of the sub-housings inserted into the main housing. Each sub-housing includes a restrained portion. The holding member includes a housing restraining portion extending in a restraining portion insertion direction crossing the sub-housings stacked in the housing stacking direction. The housing restraining portion restrains the restrained portions to impede the withdrawal of each sub-housing from the main housing in a direction opposite to the housing insertion direction by being inserted into the main housing along the restraining portion insertion direction with each of the sub-housings inserted in the main housing.

DETAILED DESCRIPTION

FIGS. 1 to 4 show a joint connector according to an embodiment of the invention. This joint connector is for connecting high potential wires 4H and connecting low potential wires 4L of twisted pair cables (four twisted pair cables 2A, 2B, 2C and 2D in this embodiment). Each twisted pair cable includes the high potential wire 4H and the low potential wire 4L. The joint connector includes high potential wire terminals 10H, low potential wire terminals 10L, sub-housings 20A, 20B, 20C and 20D respectively corresponding to the twisted pair cables 2A, 2B, 2C and 2D, a main housing 30, a high potential connection conductor 40H, a low potential connection conductor 40L and a holding member 50.

In each of the twisted pair cables 2A to 2D, the high potential wire 4H and the low potential wire 4L are twisted to each other. A high potential signal and a low potential signal are caused to flow respectively in the high potential wire 4H and the low potential wire 4L, and necessary information is transmitted by a potential difference between these signals.

The high potential wire terminals 10H are mounted on ends of the respective high potential wires 4H, and the low potential wire terminals 10L are mounted on ends of the respective low potential wires 4L. Each of the high and low potential wire terminals 10H, 10L is constituted by a female crimping terminal.

Figure 1:
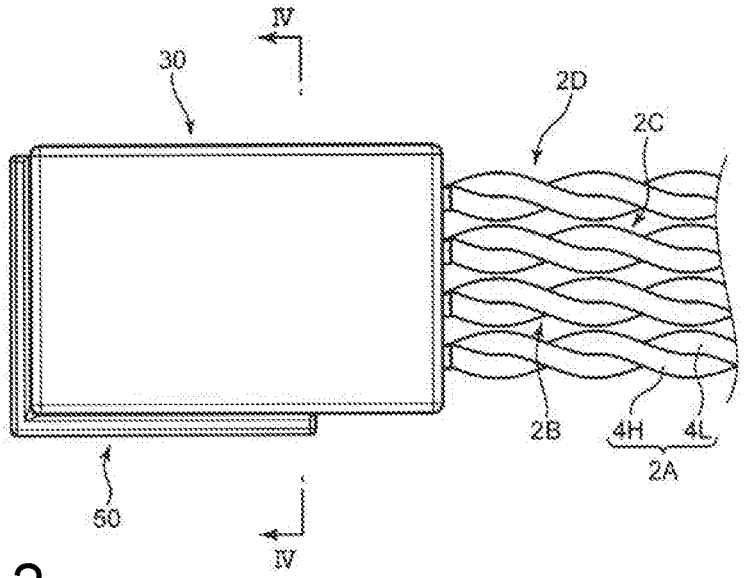
FIG. 1 is an exploded perspective view of a joint connector according to an embodiment of the present invention.
Figure 2:
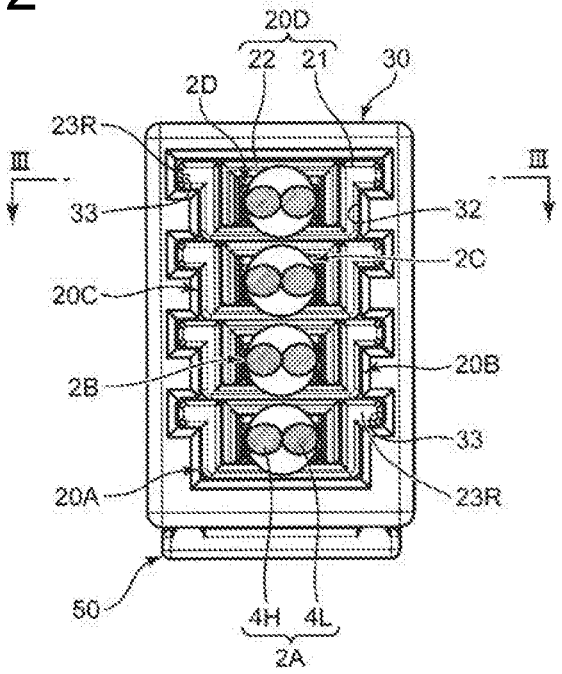
FIG. 2 is a front view partly in section of the joint connector.
Figure 3:
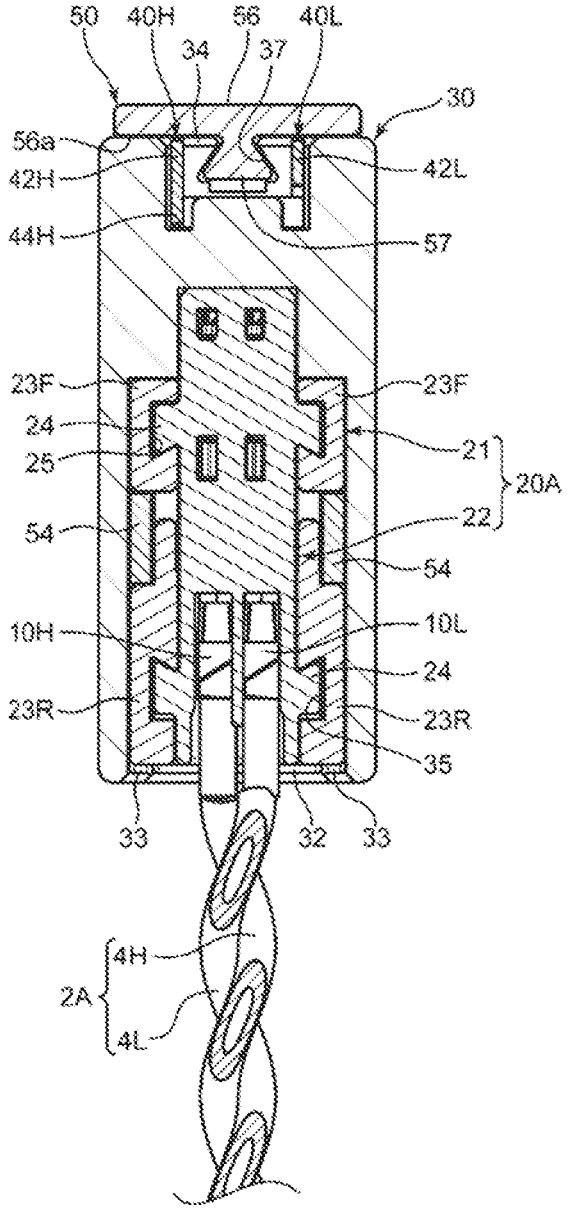
FIG. 3 is a plan view in section along III-III of FIG. 2 of the joint connector.
Figure 4:
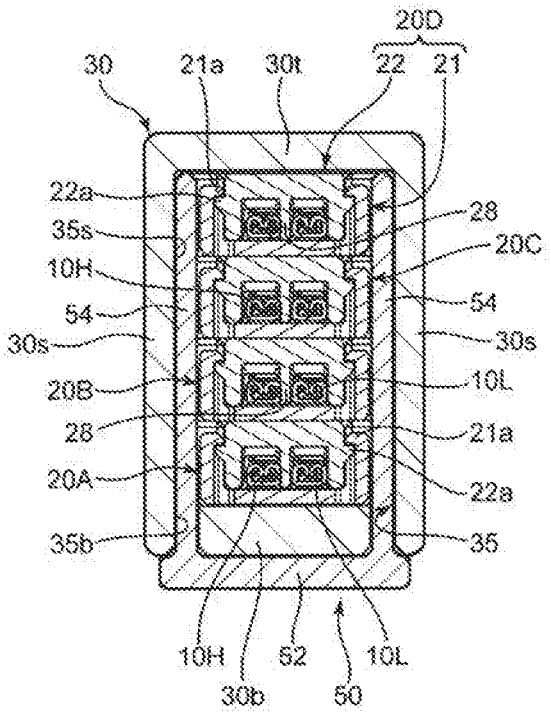
FIG. 4 is a front view in section along IV-IV of FIG. 1 of the joint connector.
Figure 5:
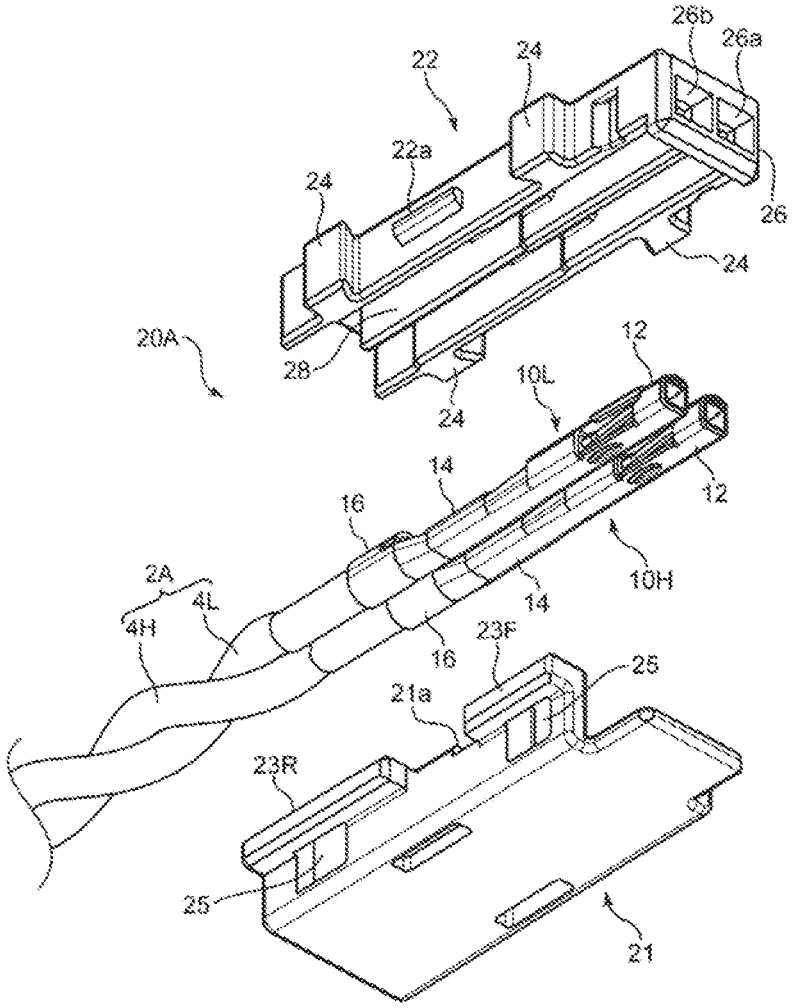
FIG. 5 is an exploded perspective view showing a high potential wire terminal and a low potential wire terminal and a sub-housing included in the joint connector.

FIG. 5 representatively shows the high and low potential wire terminals 10H, 10L mounted on the end of the twisted pair cable 2A. The other wire terminals are identical in shape and structure. Each of the high and low potential wire terminals 10H, 10L is formed by a single metal plate and integrally includes a female electrical contact portion 12, a conductor crimping portion 14 and an insulation crimping portion 16. The conductor crimping portion 14 includes two conductor barrels and is crimped to a center conductor to embrace the center conductor exposed at the end of the high potential wire 4H or the low potential wire 4L. Similarly, the insulation crimping portion 16 includes two insulation barrels and is crimped to an insulation coating to embrace the insulation coating located immediately behind the center conductor.

Each of the sub-housings 20A to 20D holds the high and low potential wire terminals 10H, 10L mounted on the ends of the high and low potential wires 4H, 4L of the corresponding twisted pair cable (twisted pair cable 2A in the case of the sub-housing 20A) so that the high and low potential wire terminals 10H, 10L are arranged in a specific terminal arrangement direction (lateral direction in a reference orientation shown in FIGS. 1 to 25).

Figure 6:
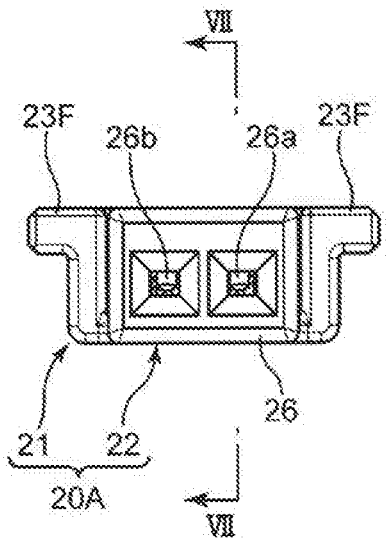
FIG. 6 is a front view of the sub-housing holding the high and low potential wire terminals.
Figure 7:
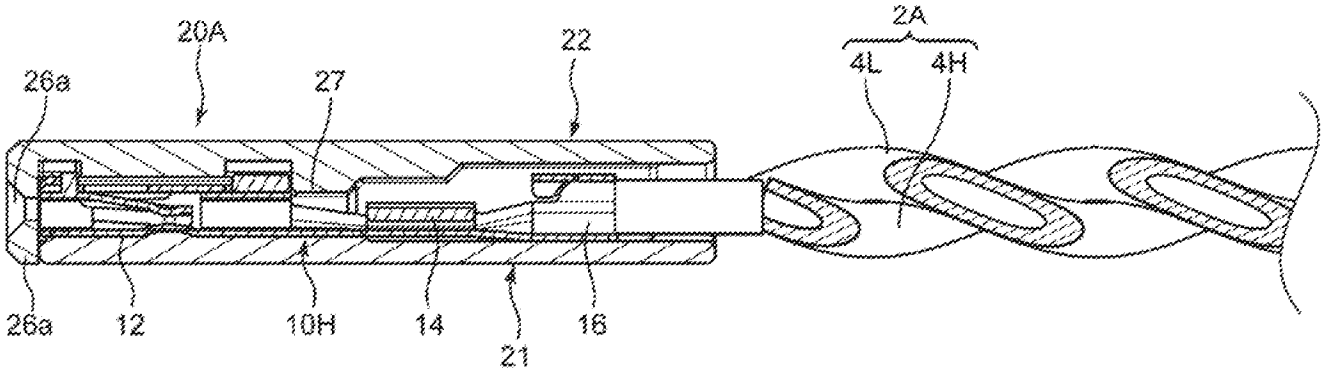
FIG. 7 is a side view in section along VII-VII of FIG. 6 of the sub-housing.
Figure 8:
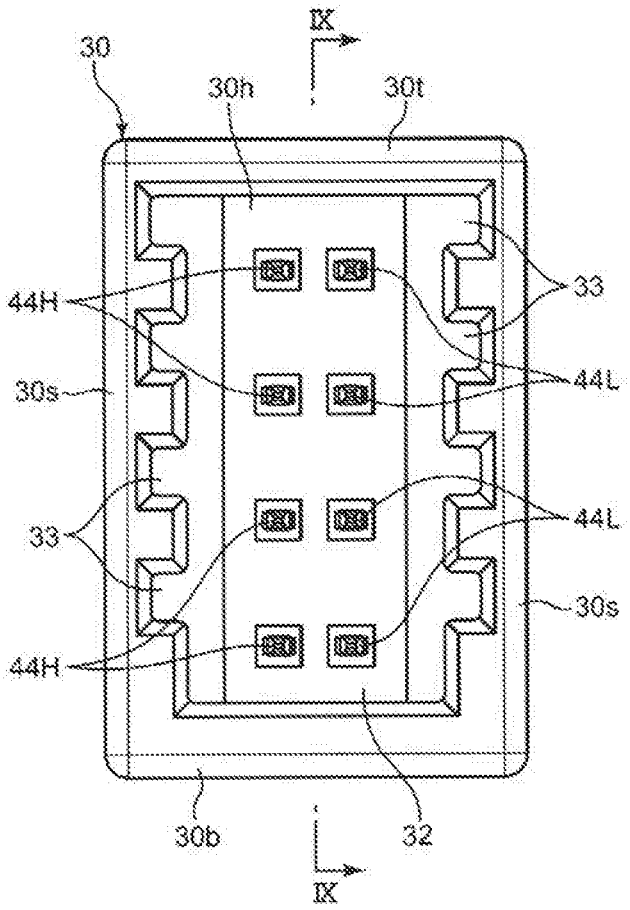
FIG. 8 is a front view showing a main housing included in the joint connector and high and low potential connection conductors held in the main housing.

FIGS. 5 to 7 representatively show the sub-housing 20A to 20D holding the low and high potential wire terminals 10H, 10L mounted on the end of the twisted pair cable 2A. The other sub-housings 20B to 20D are identical in shape and structure.

Each of the sub-housings 20A to 20D is composed of a lower housing member 21 and an upper housing member 22 that are separable in a housing separation direction (vertical direction in the above reference orientation). The lower and upper housing members 21, 22 are made of an insulating material, such as synthetic resin. The lower and upper housing members 21, 22 sandwich the high and low potential wire terminals 10H, 10L in the vertical direction by overlapping each other in the vertical direction, thereby holding the high and low potential wire terminals 10H, 10L.

The upper housing member 22 includes left and right side surfaces that are side surfaces facing in the terminal arrangement direction, front and rear fitting projections 24 projecting farther out from each of the left and right side surfaces, and engaging projections 22*a* each projecting out between the fitting projections 24. The lower housing member 21 includes fitting recesses 25 for receiving the respective fitting projections 24 and engaging projections 21*a* (FIG. 4) for holding the housing members 21, 22 in a united condition by being engaged with the engaging projections 22*a*.

The upper housing member 22 includes a protection wall 26, a partition wall 28 (FIG. 5) and a terminal locking projection 27 (FIG. 7). The protection wall 26 covers the high and low potential wire terminals 10H, 10L at a position on a front side, and is formed with terminal insertion holes 26*a*, 26*b* corresponding to the respective wire terminals 10H, 10L. The partition wall 28 keeps the high and low potential wire terminals 10H and 10L insulated by being interposed between the wire terminals 10H, 10L in the united condition. The terminal locking projection 27 locks the wire terminals 10H, 10L to impede the withdrawal of the wire terminals 10H, 10L from the sub-housing 20A to 20D by being located immediately behind the rear ends of the electrical contact portions 12 of the respective wire terminals 10H, 10L in the united state.

The lower housing member 21 includes left and right positioning ribs. Each positioning rib is divided into a front rib 23F and a rear rib 23R, as shown in FIG. 5 in a front-rear direction, i.e. a direction parallel to an axial direction of the wire terminals 10H, 10L, and a clearance is present between the ribs. The ribs 23F, 23R project farther out from the upper ends of the left and right side surfaces facing in the terminal arrangement direction, and extend in the front-rear direction. The respective fitting recesses 25 penetrate through the respective ribs 23F, 23R in the vertical direction to reach parts below the ribs 23F, 23R.

Figure 9:
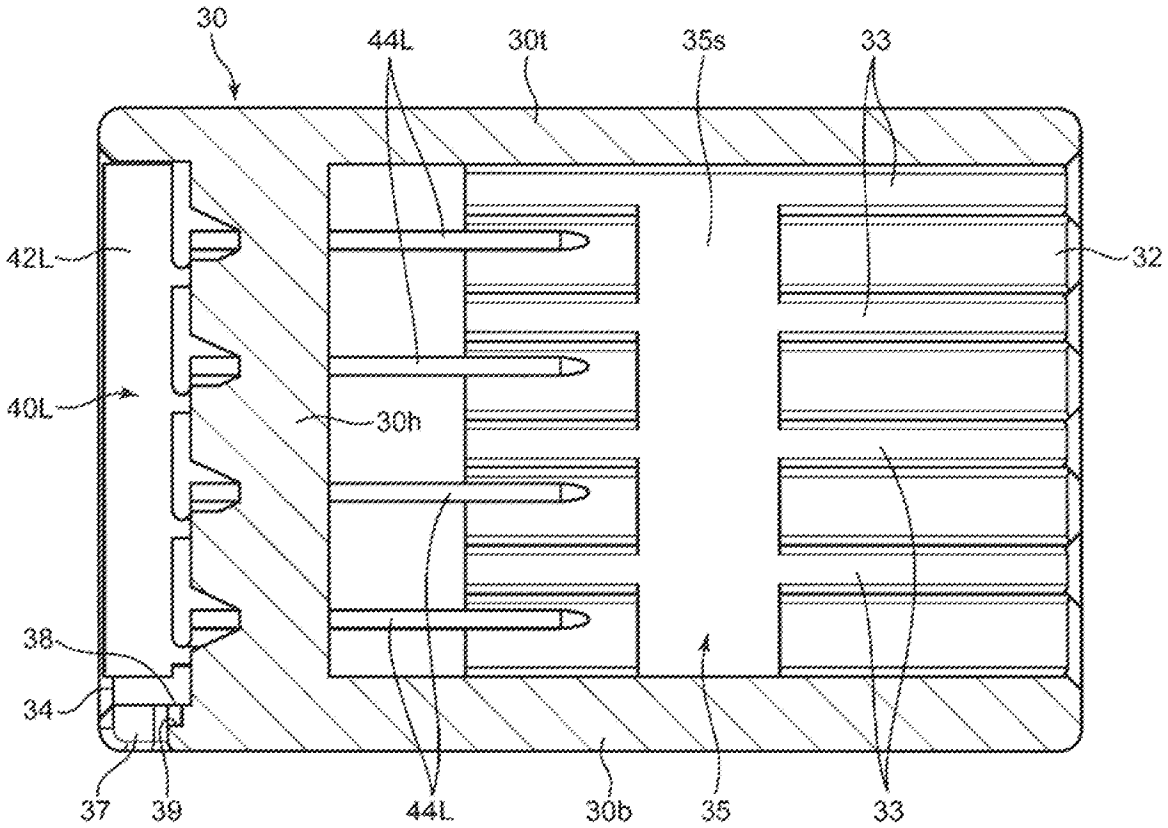
FIG. 9 is a side view in section along IX-IX of FIG. 8 showing the main housing and the high and low potential connection conductors held in the main housing.
Figure 10:
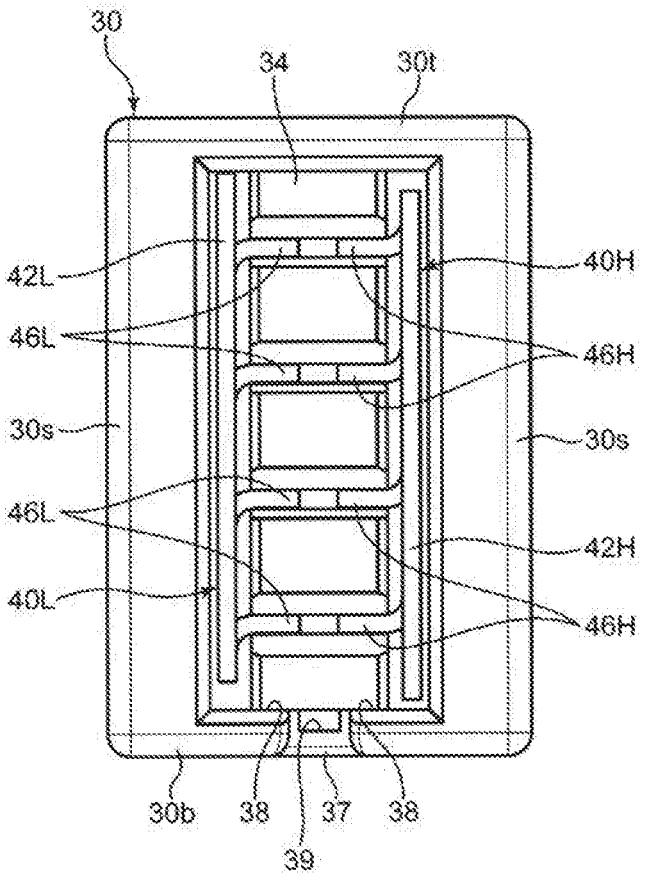
FIG. 10 is a back view showing the main housing and the high and low potential connection conductors held in the main housing.
Figure 11:
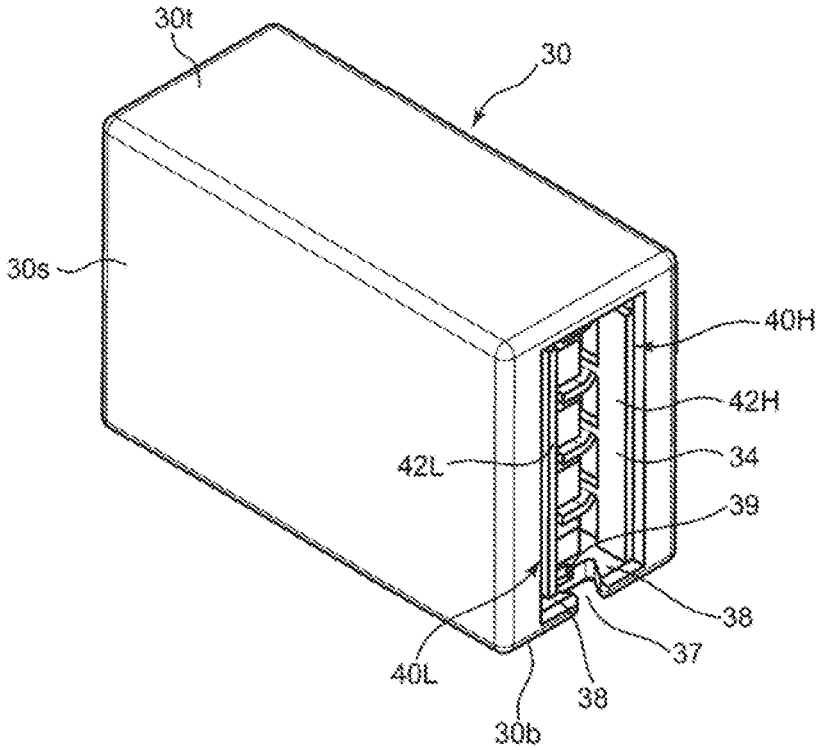
FIG. 11 is a perspective view showing the main housing and the high and low potential connection conductors held in the main housing.
Figure 12:
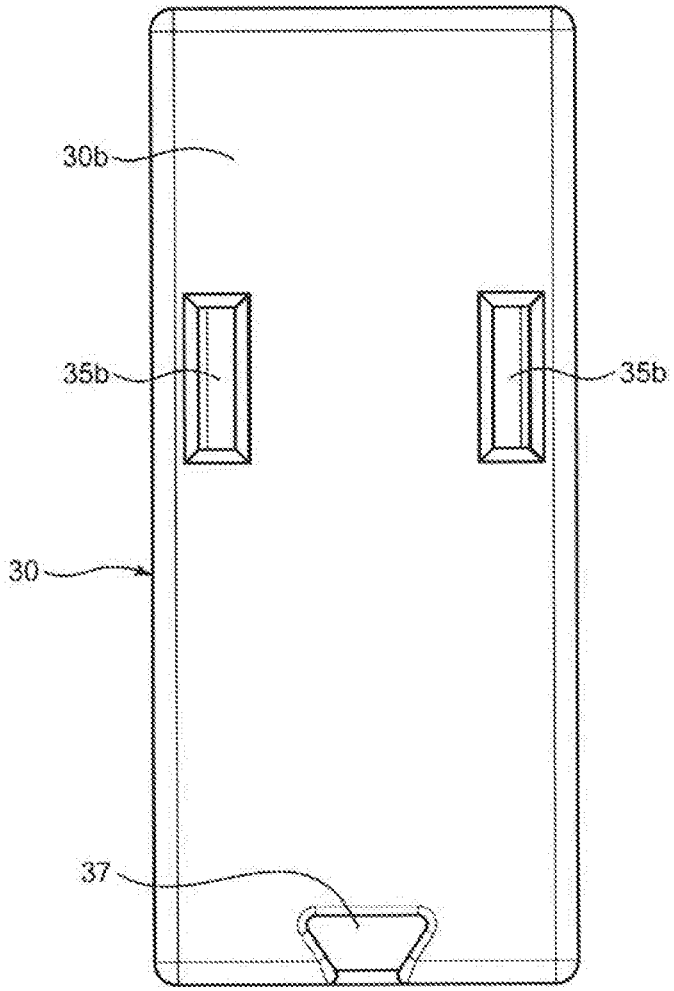
FIG. 12 is a bottom view of the main housing.

The main housing 30 is in the form of a box including a sub-housing insertion opening 32 open in a specific direction (forward direction in the reference orientation; rightward direction in FIG. 9), and receives the sub-housings 20A to 20D inserted along a housing insertion direction (direction parallel to the axial direction of the respective wire terminals 10H, 10L; front-rear direction in the reference orientation) through the sub-housing insertion opening 32. In this way, the main housing 30 accommodates the sub-housings 20A to 20D in such an array that the sub-housings 20A to 20D are stacked successively in a housing stacking direction (direction perpendicular to the terminal arrangement direction and the housing insertion direction; vertical direction in the reference orientation) from the bottom.

The main housing 30 according to this embodiment is molded of an insulating material, such as synthetic resin, and integrally includes a bottom wall 30*b*, left and right side walls 30*s* rising up from both left and right sides of the bottom wall 30*b*, a ceiling wall 30*t* connecting the upper ends of the side walls 30*s* and a connection conductor holding wall 30*h*, which is an inner wall located on a rear end side, i.e. on a side opposite to the sub-housing insertion opening 32. The bottom wall 30*b*, the side walls 30*s* and the ceiling wall 30*t* define a housing accommodation space for accommodating the sub-housings 20A to 20D, and the connection conductor holding wall 30*h* constitutes a back end (final end in the housing insertion direction) of the housing accommodation space. Further, the main housing 30 includes a connection conductor insertion opening 34 open on a side opposite to the sub-housing insertion opening 32 (rear side in the reference orientation) and the connection conductor holding wall 30*h* is open also rearward through the connection conductor insertion opening 34.

The side walls 30*s* are formed with positioning grooves 33 over a plurality of stages in the vertical direction. The positioning grooves 33 extend in the housing insertion direction (front-rear direction in the reference orientation) and determine the positions of the respective sub-housings 20A to 20D by receiving the positioning ribs (i.e. front and rear ribs 23F, 23R) of the sub-housings 20A to 20D inserted in the housing insertion direction. The positioning of the sub-housings 20A to 20D obviates the need for partition walls between the adjacent sub-housings and enables a size reduction of the main housing 30 in the housing stacking direction.

Each of the high and low potential connection conductors 40H, 40L is formed integrally of a metal plate excellent in conductivity and is held in the main housing 30, thereby functioning as media for connecting the high potential wire terminals 10H to each other and connecting the low potential wire terminals 10L to each other.

Figure 13:
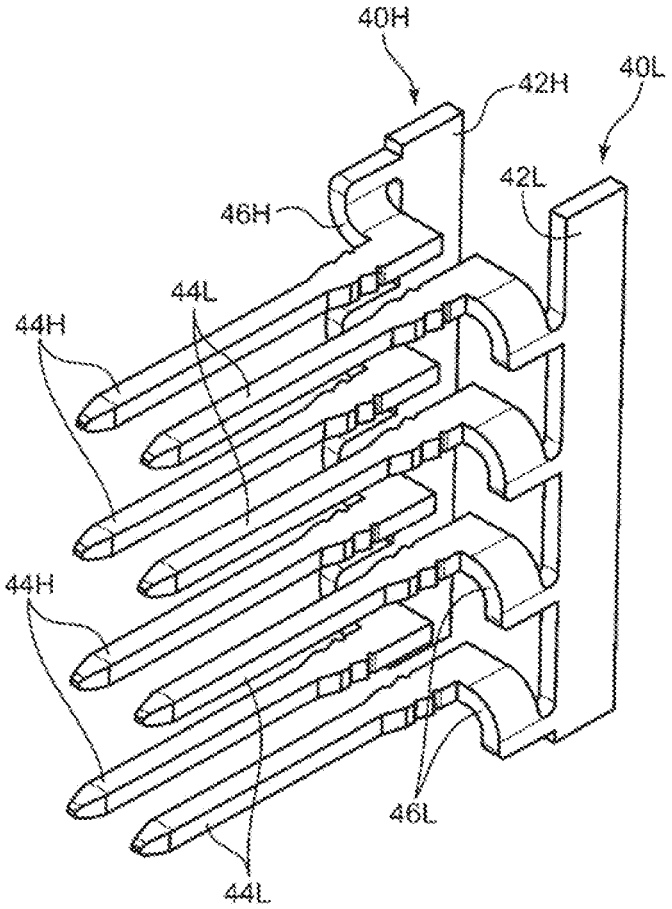
FIG. 13 is a perspective view showing the high and low potential connection conductors.
Figure 14:
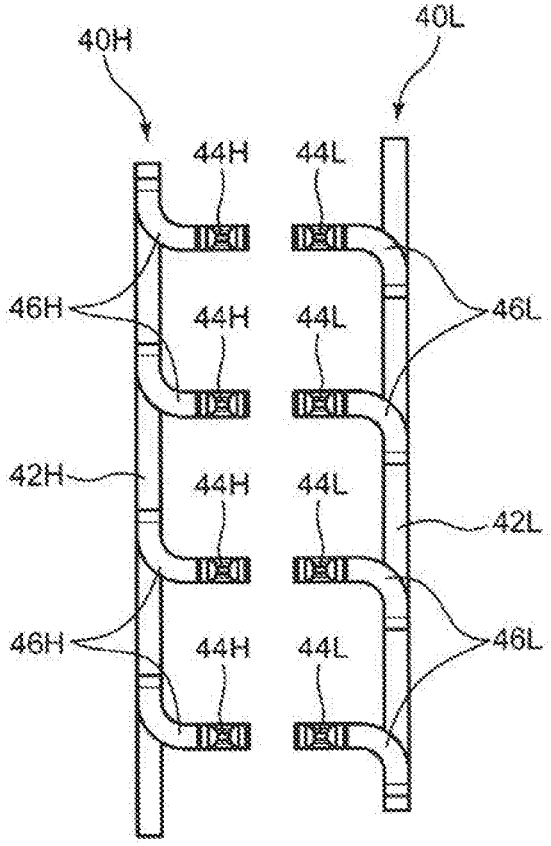
FIG. 14 is a front view showing the high and low potential connection conductors.

As also shown in FIGS. 13 and 14, the high potential connection conductor 40H integrally includes a high potential shorting portion 42H, high potential connection terminals 44H and relay portions 46H. The low potential connection conductor 40L integrally includes a low potential shorting portion 42L, low potential connection terminals 44L and relay portions 46L.

Each high and low potential shorting portion 42H, 42L is in the form of a strip extending in one direction, and is held in the main housing 30 in such an orientation that the high and low potential shorting portions 42H, 42L extend in parallel in the housing stacking direction (vertical direction in the reference orientation) while being spaced apart from each other. Specifically, the high and low potential shorting portions 42H, 42L are inserted into the main housing 30 through the connection conductor insertion opening 34 of the main housing 30 and press-fit into the connection conductor holding wall 30*h* of the main housing 30 to be fixed.

Each of the high and low potential connection terminals 44H, 44L is a tab-like male terminal extending in the housing insertion direction (front-rear direction in the reference orientation), and projects forward of the connection conductor holding wall 30*h* through the connection conductor holding wall 30*h* (i.e. into the housing accommodation space). The high potential connection terminals 44H are arrayed at intervals in a direction parallel to the housing stacking direction (vertical direction in the reference orientation) and are connected respectively to the high potential shorting portion 42H via the relay portions 46H. Similarly, the low potential connection terminals 44L are arrayed at intervals in a direction parallel to the housing stacking direction (vertical direction in the reference orientation) and are connected respectively to the low potential shorting portion 42L via the relay portions 46L. Thus, the high potential shorting portion 42H has a function of shorting the high potential connection terminals 44H to each other, and the low potential shorting portion 42L has a function of shorting the plurality of low potential connection terminals 44L to each other.

The high potential connection terminals 44H are set at positions respectively corresponding to the high potential wire terminals 10H, and the low potential connection terminals 44L are set at positions respectively corresponding to the low potential wire terminals 10L. In particular, the high and low potential connection terminals 44H, 44L are arrayed so that the high potential connection terminals 44H and the low potential connection terminals 44L can fit into the high potential wire terminals 10H and the low potential wire terminals 10L through the terminal insertion holes 26*a*, 26*b* of the respective sub-housings 20 as the sub-housings 20A to 20D are inserted into the main housing 30 in the housing insertion direction. Thus, the high and low potential connection terminals 44H, 44L are arranged so that each of the high and low potential connection terminals 44H, 44L are juxtaposed in the terminal arrangement direction (lateral direction in the reference orientation).

The relay portions 46H, 46L are shaped to offset the high and low potential connection terminals 44H, 44L inwardly from the high and low potential shorting portions 42H, 42L. This enables an interval between the high and low potential shorting portions 42H, 42L to be widened while matching an interval between each pair of high and low potential connection terminals 44H, 44L with an interval between the high and low potential wire terminals 10H, 10L arranged in the terminal arrangement direction in each sub-housing 20A to 20D.

Figure 15:
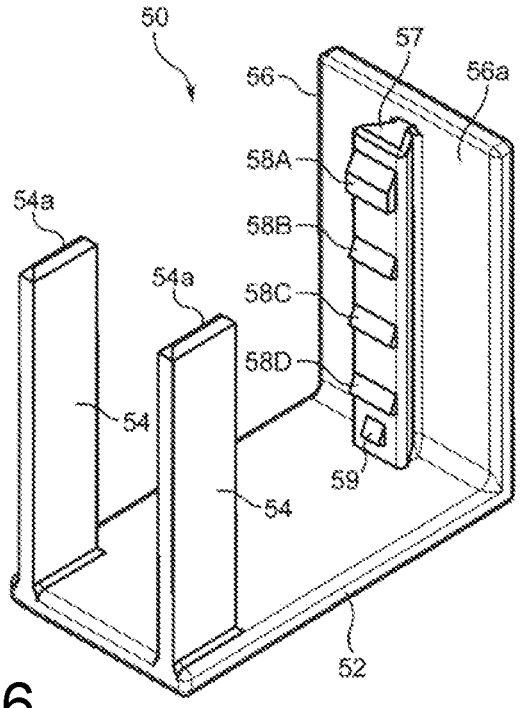
FIG. 15 is a perspective view of a holding member included in the joint connector.
Figure 16:
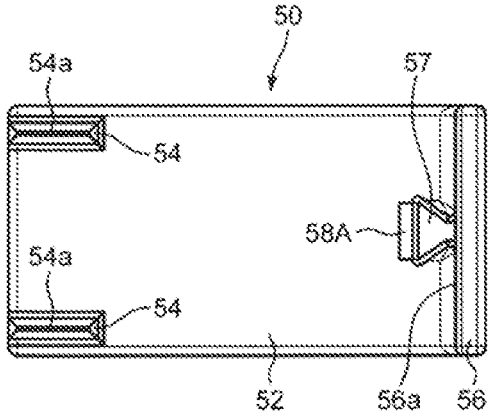
FIG. 16 is a plan view of the holding member.
Figure 17:
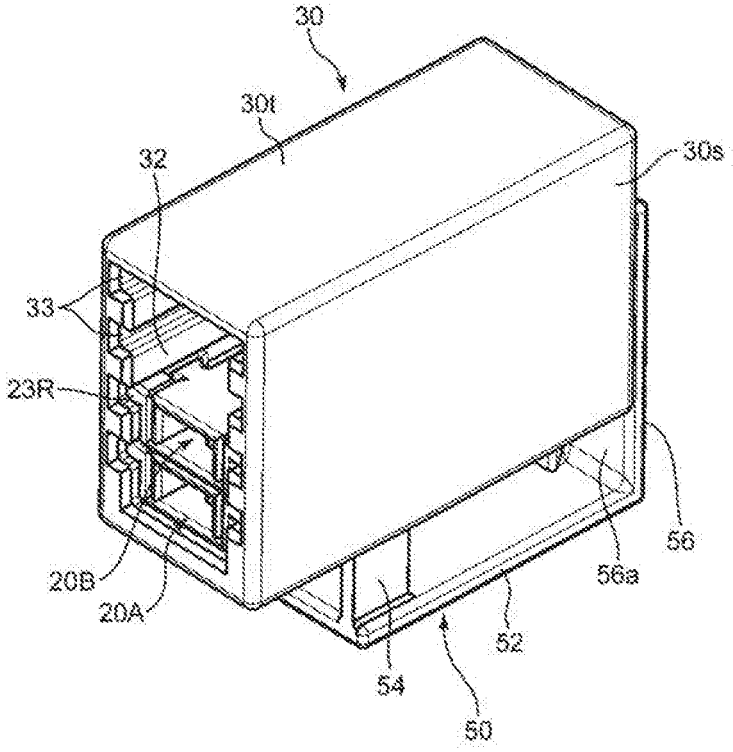
FIG. 17 is a perspective view showing a state where the holding member is locked at a third insertion/withdrawal allowing position by the main housing in the joint connector.
Figure 18:
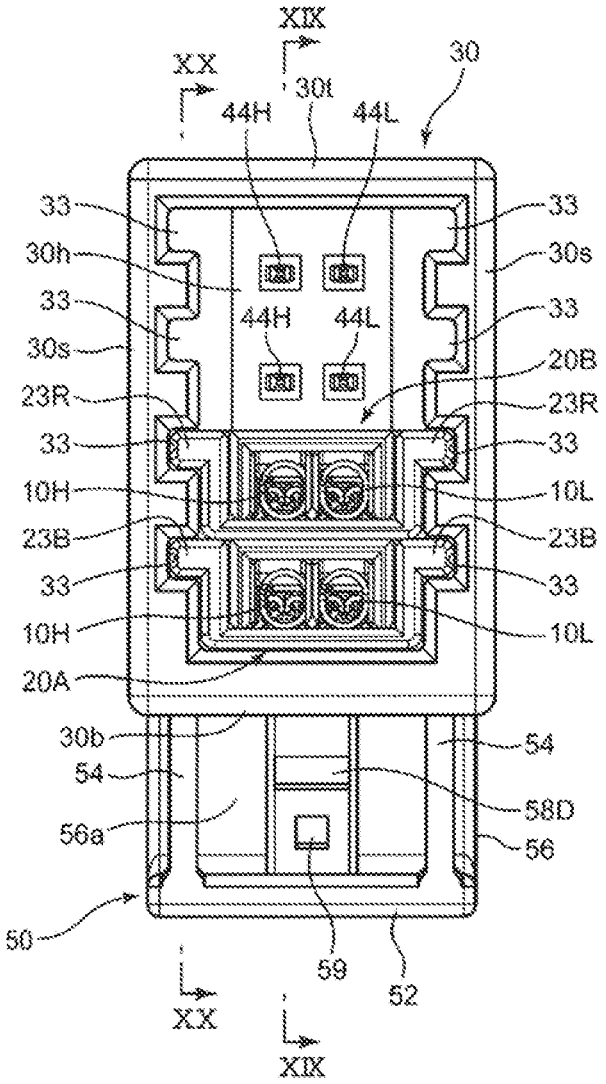
FIG. 18 is a front view showing the state shown in FIG. 17.
Figure 19:
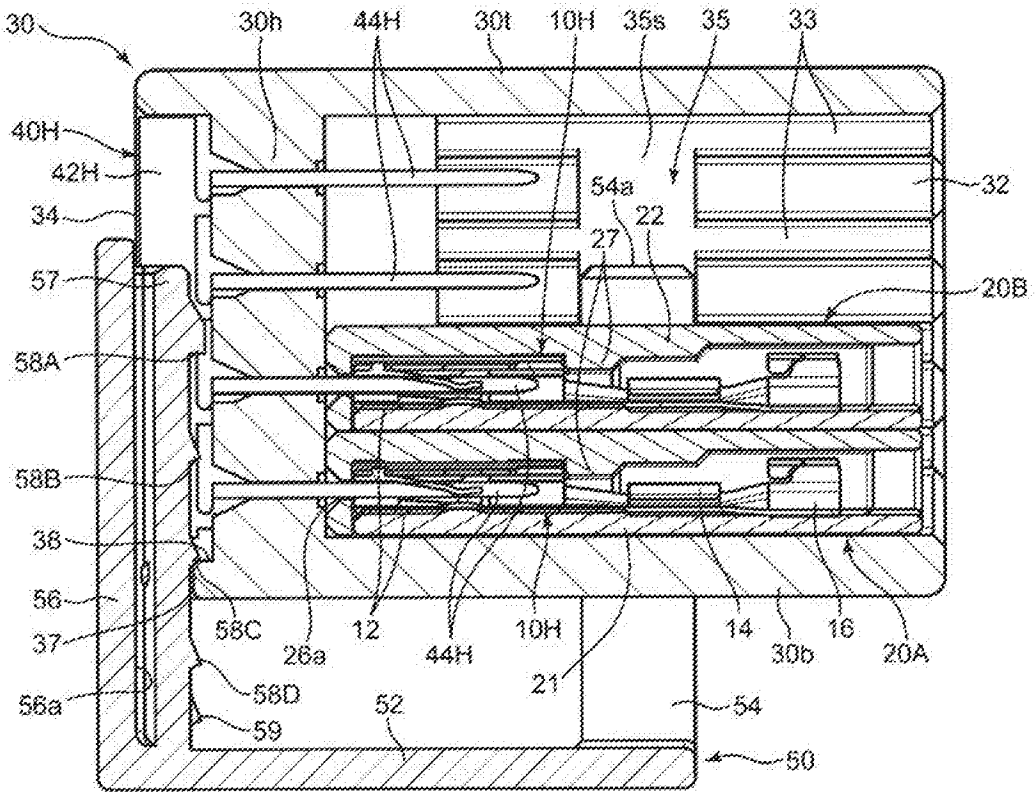
FIG. 19 is a side view in section along XIX-XIX of FIG. 18 showing the state shown in FIG. 17.
Figure 20:
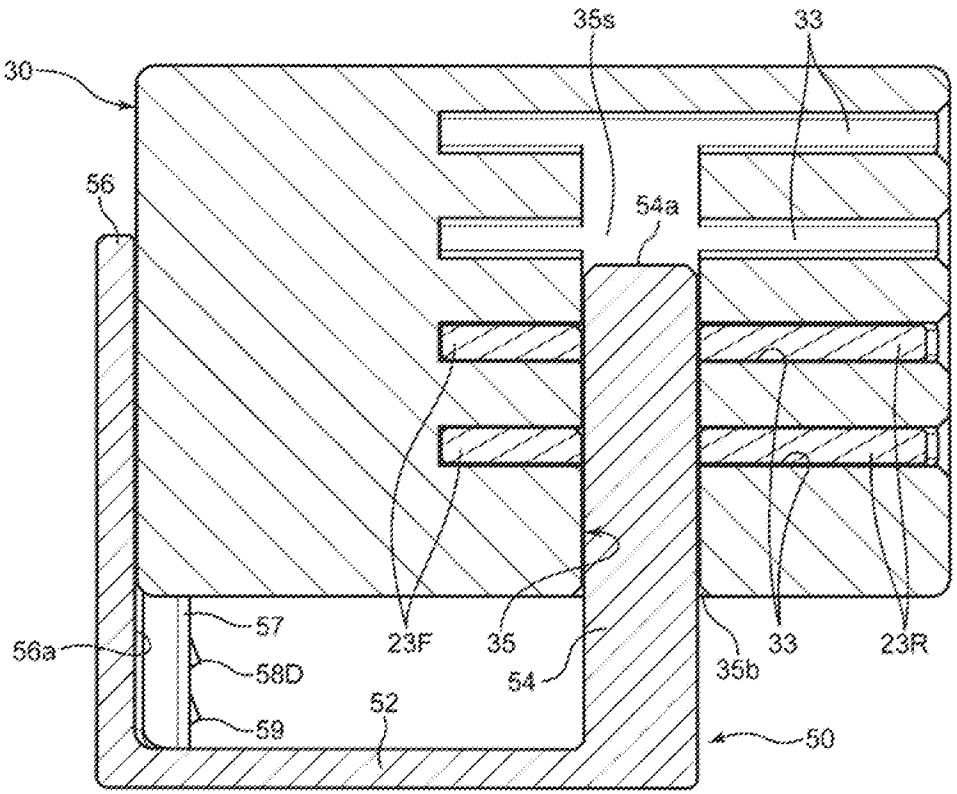
FIG. 20 is a side view in section along XX-XX of FIG. 18 showing the state shown in FIG. 17.
Figure 21:
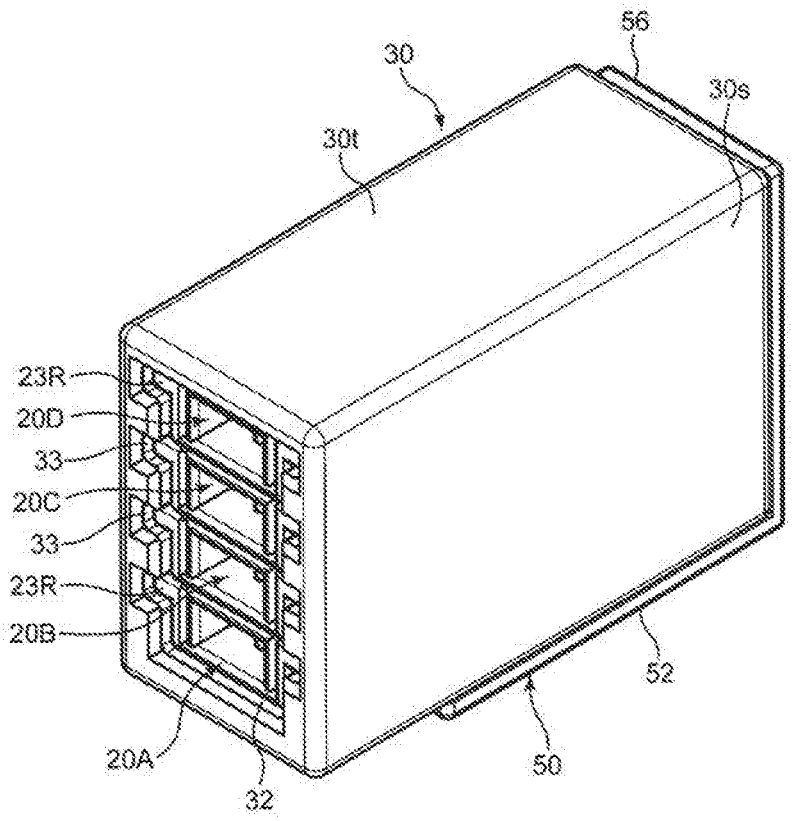
FIG. 21 is a perspective view showing a state where the holding member is locked at a completely restraining position by the main housing in the joint connector.
Figure 22:
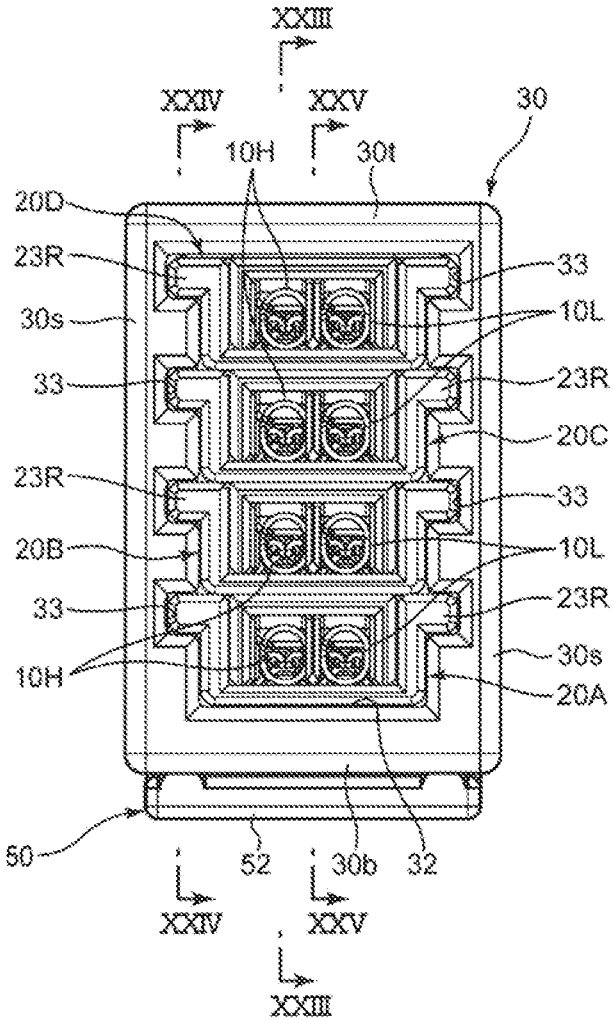
FIG. 22 is a front view showing the state shown in FIG. 21.
Figure 23:
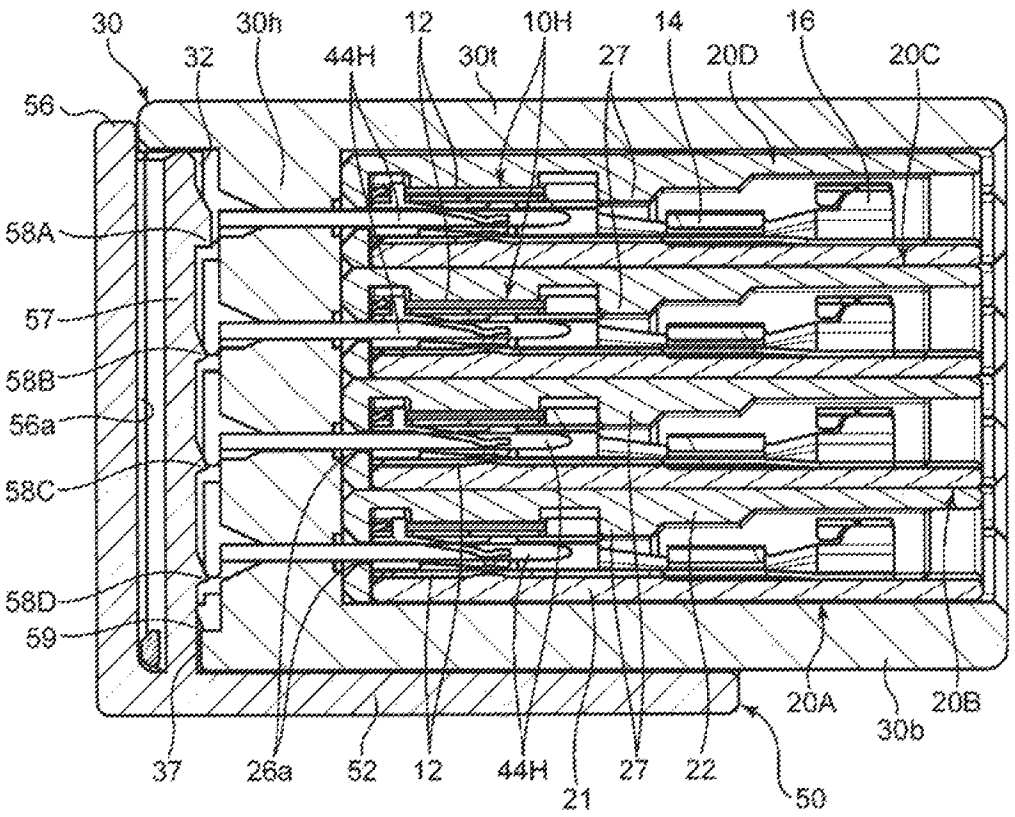
FIG. 23 is a side view in section along XXIII-XXIII of FIG. 22 showing the state shown in FIG. 21.
Figure 24:
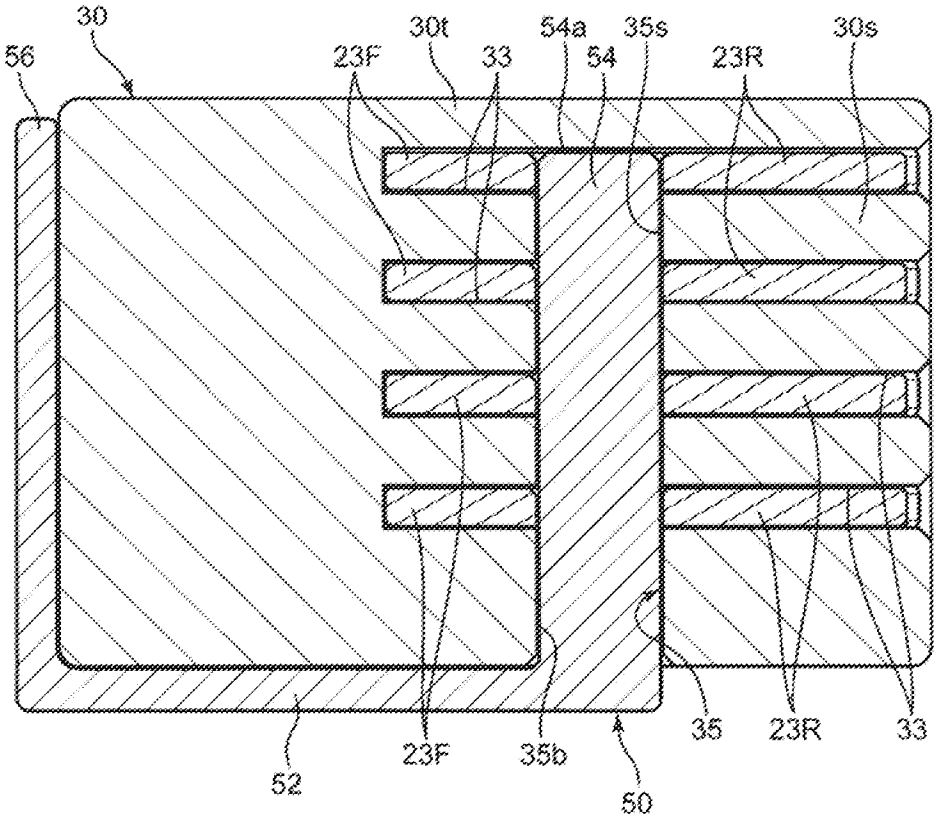
FIG. 24 is a side view in section along XXIV-XXIV of FIG. 22 showing the state shown in FIG. 21.
Figure 25:
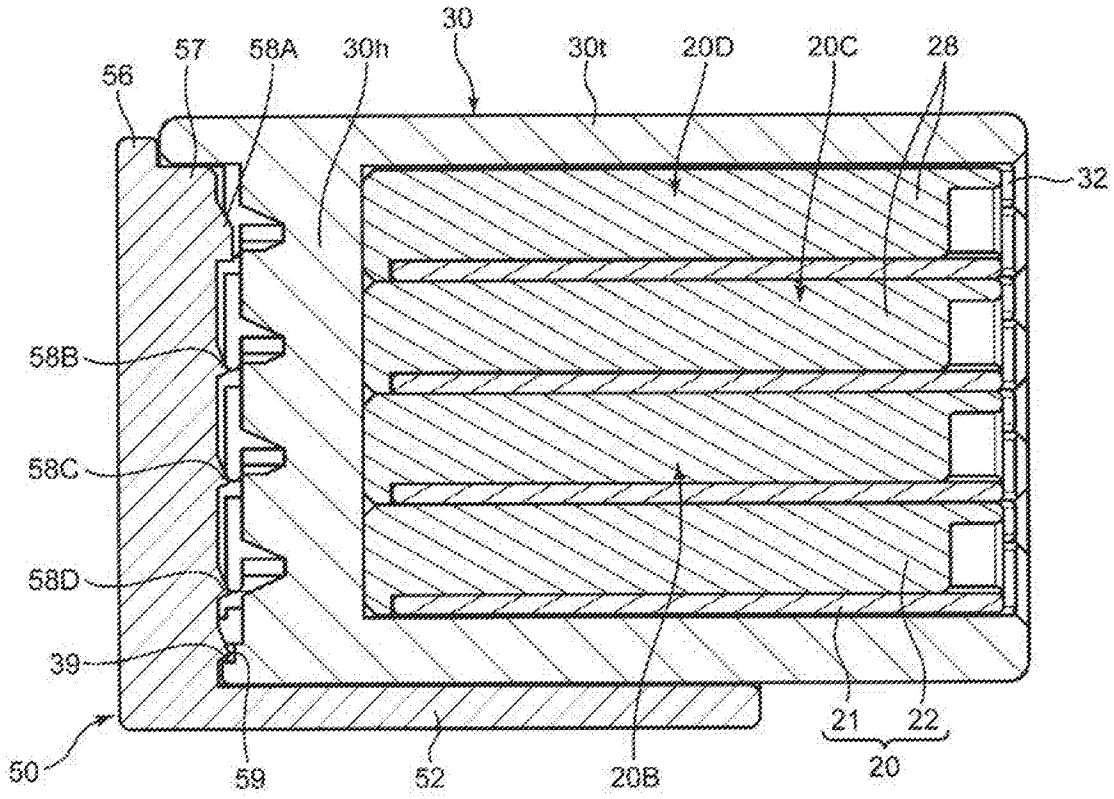
FIG. 25 is a side view in section along XXV-XXV of FIG. 22 showing the state shown in FIG. 21.

The holding member 50 is to be mounted into the main housing 30 to collectively hold the sub-housings 20A, 20D inserted into the main housing 30 as described above. The holding member 50 is molded of an insulating material, such as synthetic resin, and integrally includes a base 52, two housing restraining portions 54 and a cover 56, as shown in FIGS. 15 and 16.

The base 52 is arranged horizontally along the bottom wall 30*b* below the bottom wall 30*b* of the main housing 30 in the reference orientation. The base 52 has a function of coupling the housing restraining portions 54 and the cover 56 to each other.

The two housing restraining portions 54 are connected integrally to the base 52 and in the form of strips extending in a predetermined restraining portion insertion direction (direction crossing the plurality of sub-housings 20A to 20D stacked in the housing stacking direction; vertical direction in this embodiment). Specifically, the two housing restraining portions 54 extend up from both left and right edges of one end part in the front-rear direction (front end part in the housing insertion direction; left end part in FIGS. 15 and 16) of the base 52.

The two housing restraining portions 54 restrain each of the sub-housings 20A to 20D (front ribs 23F in this embodiment) to impede the withdrawal of the sub-housings 20A to 20D from the main housing 30 in a direction (forward direction in the reference orientation) opposite to the housing insertion direction by being inserted into the main housing 30 along the restraining portion insertion direction (upward direction in the reference orientation).

Specifically, the main housing 30 is formed with two restraining portion insertion paths 35 into which the housing restraining portions 54 are respectively insertable in the upward direction. Each restraining portion insertion path 35 is composed of a through hole 35*b* penetrating through the bottom wall 30*b* and a recessed groove 35*s* formed across the positioning grooves 33 in the restraining portion insertion direction (vertical direction in the reference orientation) in each of the side walls 30*s*, and the recessed groove 35*s* is formed at a position corresponding to an interval between the front and rear ribs 23F, 23R in each sub-housing 20A to 20D. As shown in FIGS. 1 to 4 and 21 to 25, the two housing restraining portions 54 are inserted fully into the respective restraining portion insertion paths 35 from bottom to top, thereby reaching a completely restraining position. This completely restraining position is immediately behind (below in FIG. 3, on the right side in FIG. 24) the front ribs 23F of the sub-housings 20A to 20D stacked one over another in the housing accommodation space. At this completely restraining position, the housing restraining portions 54 can collectively restrain the respective front ribs 23F to impede rearward withdrawal of the sub-housings 20A to 20D from the main housing 30.

The cover 56 is shaped to cover the connection conductor insertion opening 34 of the main housing 30 with the two housing restraining portions 54 fully inserted, i.e. with the holding member 50 arrived at the completely restraining position. Specifically, the cover 56 according to this embodiment is in the form of a plate rising upright from the other end part in the front-rear direction (back end part in the housing insertion direction; left end part in FIGS. 15 and 16) of the base 52.

A back surface 56*a* of the cover 56 faces the main housing 30. The back surface 56*a* and the main housing 30 are formed with fitting portions that fit to each other. Specifically, a fitting projection 57 is formed in a laterally central part of the back surface 56*a* of the cover 56 and projects farther inward of the main housing 30 than other parts. The main housing 30 is formed with a fitting recess 37 that fits to the fitting projection 57. The fitting projection 57 is a rib extending in the restraining portion insertion direction (vertical direction in the reference orientation) and has a uniform cross-sectional shape. The fitting recess 37 is formed in a center of a rear end part (end part on the side of the connection conductor insertion opening 34) of the bottom wall 30*b* of the main housing 30 and is shaped to fit to the fitting projection 37.

The cross-sectional shape of the fitting projection 57 and the shape of the fitting recess 37 corresponding thereto are set to determine a relative position of the holding member 50 with respect to the main housing 30 in the housing insertion direction and the terminal arrangement direction (front-rear direction and lateral direction in the reference orientation) while allowing the holding member 50 to slide with respect to the main housing 30 in the restraining portion insertion direction (vertical direction in the reference orientation) by fitting the fitting projection 57 and the fitting recess 37. Specifically, the cross-sectional shape (trapezoidal shape in figures) of the fitting projection 57 according to this embodiment is set such that a width thereof becomes larger toward an inner side of the main housing 30.

The fitting projection 57 is movable in an area between the high and low potential shorting portions 42H, 42L in the main housing 30. In other words, the interval between the high and low potential shorting portions 42H, 42L is set to be large enough to allow the arrangement of the fitting projection 57 between the high and low potential shorting portions 42H, 42L.

The main housing 30 has a function of locking the holding member at a plurality of positions. The locking positions include the completely restraining position and insertion/withdrawal allowing positions in front of the completely restraining position. The insertion/withdrawal allowing positions are arranged along the restraining portion insertion direction (vertical direction in the reference orientation) so that the number of the sub-housings allowed to be inserted and withdrawn along the housing insertion direction increases with distance from the completely restraining position, and include a first insertion/withdrawal allowing position, a second insertion/withdrawal allowing position, a third insertion/withdrawal allowing position and a fourth insertion/withdrawal allowing position in this embodiment.

The first insertion/withdrawal allowing position is a position where an insertion depth of the two housing restraining portions 54 is smallest (relative positions of the housing restraining portions 54 with respect to the main housing 30 are lowest in the reference orientation) and tips 54*a* (upper ends in the reference orientation) of the housing restraining portions 54 are located in front of (below in the reference orientation) the ribs 23F, 23R of the sub-housing 20A in the lowermost stage. That is, the housing restraining portions 54 at the first insertion/withdrawal allowing position allow the insertion and withdrawal of the sub-housing 20A and the sub-housing 20B to 20D above the sub-housing 20A, i.e. all the sub-housings into and from the main housing 30.

The second insertion/withdrawal allowing position is a position where the insertion depth of the two housing restraining portions 54 is smallest next to that at the first insertion/withdrawal allowing position, the housing restraining portions 54 are interposed between the front ribs 23F and the rear ribs 23R of the sub-housing 20A in the lowermost stage and the tips 54*a* of the housing restraining portions 54 are located in front of (below) the ribs 23F, 23R of the sub-housing 20B in the second stage from bottom. That is, the housing restraining portions 54 at the second insertion/withdrawal allowing position non-withdrawably restrain the sub-housing 20A, but allow the insertion and withdrawal of the sub-housings 20B to 20D into and from the main housing 30.

The third insertion/withdrawal allowing position is a position as also shown in FIGS. 17 to 20 where the insertion depth of the pair of housing restraining portions 54 is smallest next to that at the second insertion/withdrawal allowing position, the housing restraining portions 54 are interposed between the front ribs 23F and the rear ribs 23R of the sub-housings 20A, 20B in the lowermost stage and the second stage from bottom, and the tips 54*a* of the housing restraining portions 54 are located in front of (below) the ribs 23F, 23R of the sub-housing 20C in the third stage from bottom. That is, the housing restraining portions 54 at the third insertion/withdrawal allowing position non-withdrawably restrain the sub-housings 20A, 20B, but allow the insertion and withdrawal of the sub-housings 20C, 20D into and from the main housing 30.

The fourth insertion/withdrawal allowing position is, out of the plurality of insertion/withdrawal allowing positions, a position where the insertion depth of the pair of housing restraining portions 54 is largest (relative positions of the pair of housing restraining portions 54 with respect to the main housing 30 are highest in the reference orientation), the housing restraining portions 54 are interposed between the front ribs 23F and the rear ribs 23R of the sub-housings 20A, 20B and 20C in the first to third stages from bottom and the tips 54*a* of the housing restraining portions 54 are located in front of (below) the ribs 23F, 23R of the sub-housing 20D in the uppermost stage. That is, the housing restraining portions 54 at the fourth insertion/withdrawal allowing position non-withdrawably restrain the sub-housings 20A, 20B and 20C, but allow the insertion and withdrawal of the sub-housing 20D in and from the main housing 30.

The completely restraining position is a position where the pair of housing restraining portions 54 are fully inserted as described above (relative positions of the pair of housing restraining portions 54 with respect to the main housing 30 are even higher than at the fourth insertion/withdrawal allowing position in the reference orientation) and restrain the front ribs 23F to impede the withdrawal of any of the sub-housings 20A to 20D by crossing between the front ribs 23F and the rear ribs 23R of all the sub-housings 20A to 20D as shown in FIGS. 1 to 4 and 21 to 25.

Specifically, the main housing 30 includes a pair of partial locking surfaces 38, which are insertion/withdrawal allowing locking portions, and a full locking surface 39, which is a completely restraining locking portion, and the holding member 50 includes a plurality of insertion/withdrawal allowing locked portions, i.e. a first locked projection 58A, a second locked projection 58B, a third locked projection 58C, a fourth locked projection 58D and a fully locked projection 59, which is a locked portion for complete restraint.

The partial locking surfaces 38 are formed by parts of the upper surface of the bottom wall 30*b* of the main housing 30 located on both left and right sides of the fitting recess 37. Further, the full locking surface 39 is a surface formed on a back part of the fitting recess 37 to have a different height lower than the upper surface of the bottom wall 30*b*.

Any of the first to fourth locked projections 58A to 58D and the fully locked projection 59, which are the plurality of locked portions, is formed on the back surface 56*a* of the covering portion 56, more particularly on the surface of the fitting projection 57 and projects inwardly of the main housing 30. The first to fourth locked projections 58A to 58D and the fully locked projection 59 are arrayed in this order from top.

Each of the first to fourth locked projections 58A to 58D has a width larger than that of the fitting recess 37. Accordingly, both widthwise end parts of the locked projection 58A to 58D come into contact with the partial locking surfaces 38 on the both left and right sides of the fitting recess 37 from above, thereby being locked to the main housing 30 to restrict a downward (direction opposite to the restraining portion insertion direction) with respect to the main housing 30. The positions of the first to fourth locked projections 58A to 58D in a direction parallel to the restraining portion insertion direction (height positions) are so set that the holding member 50 is partially locked at each of the first to fourth insertion/withdrawal allowing positions by each of the first to fourth locked projections 58A to 58B coming into contact with the partial locking surfaces 38.

The fully locked projection 59 has a width smaller than that of the fitting recess 37. Accordingly, the fully locked projection 59 enters the fitting recess 37 and comes into contact with the full locking surface 39 in the fitting recess 37 from above, thereby being lockable to restrict a downward (direction opposite to the restraining portion insertion direction) displacement with respect to the main housing 30. The position of the fully locked projection 59 in the direction parallel to the restraining portion insertion direction (height position) is so set that the holding member 50 is fully locked at the completely restraining position by the fully locked projection 59 coming into contact with the full locking surface 39.

According to this joint connector, the assembling of the joint connector and the mutual connection of the high potential wires 4H and the mutual connection of the low potential wires 4L included in each of the plurality of twisted pair cables 2A to 2D can be performed, for example, in the following manner.

Mounting of Wire Terminals on Wires

The high potential wire terminal 10H and the low potential wire terminal 10L are mounted on the end of the high potential wire 4H and the end of the low potential wire 4L included in each of the plurality of twisted pair cables 2A to 2D. Since all the high and low potential wire terminals 10H, 10L have the same shape and structure in this embodiment, there is no possibility of erroneous mounting and it is not necessary to distinguish the high and low potential wire terminals 10H, 10L. However, the present invention does not exclude a mode in which high and low potential wire terminals are mutually differently shaped or structured.

Holding of Wire Terminals by Sub-Housings

Out of the plurality of high and low potential wire terminals 10H, 10L, a pair of the high and low potential wire terminals 10H, 10L, i.e. the high and low potential wire terminals 10H, 10L belonging to the common twisted pair cable, are mounted in the sub-housing to be held by the sub-housing corresponding to the twisted pair cable, out of the plurality of sub-housings 20A to 20D. For example, the high and low potential wire terminals 10H, 10L mounted on the end of the twisted pair cable 2A are held in the sub-housing 20A, and the high and low potential wire terminals 10H, 10L mounted on the end of the twisted pair cable 2B are held in the sub-housing 20B. Specifically, the lower housing member 21 and the upper housing member 22 constituting each sub-housing 20A to 20D are united with each other to sandwich the pair of high and low potential wire terminals 10H, 10L therebetween in the housing separation direction (vertical direction in the reference orientation), whereby the terminal locking projection 27 of the upper housing member 22 locks the rear ends of the electrical contact portions 12 of the high and low potential wire terminals 10H, 10L to non-withdrawably hold the high and low potential wire terminals 10H, 10L in the sub-housing 20A to 20D.

As just described, individual mounting of the corresponding sub-housings 20A to 20D on the plurality of twisted pair cables 2A to 2D enables the respective twisted pair cables to be handled independently of each other. Thus, the mounting of the sub-housings 20A to 20D on the twisted pair cables 2A to 2D, individual inspection, maintenance and the like of the respective twisted pair cables 2A to 2D can be easily performed.

Note that the sub-housings according to the present invention are not limited to the configuration composed of mutually separable housing constituting members such as the lower housing members 21 and the upper housing members 22 of the sub-housings 20A to 20D and may be entirely integrated. However, the separation of the lower and upper housing members 21, 22 in the housing separation direction facilitates the mounting of the high and low potential wire terminals 10H, 10L into the sub-housings 20A to 20D. In addition, the plurality of sub-housings 20A to 20D are restrained in the main housing 30 while being stacked in the direction parallel to the housing separation direction, whereby inadvertent separation of the lower and upper housing members 21, 22 is reliably prevented.

Fixing of Connection Conductors in Main Housing

On the other hand, the high and low potential connection conductors 40H, 40L can be easily fixed in the main housing 30, utilizing the connection conductor insertion opening 34. Specifically, the high and low potential connection conductors 40H, 40L are inserted into the connection conductor insertion opening 34 with the high and low potential connection terminals 44H, 44L in the lead and press-fit through the connection conductor holding wall 30*h* in the main housing 30, whereby the high and low potential connection terminals 44H, 44L can be held in the connection conductor holding wall 30*h* while projecting forward from the connection conductor holding wall 30*h* (i.e. projecting into the housing accommodation space).

Partial Locking of Holding Member in Main Housing and Insertion of Sub-Housings

Further, in the main housing 30, successive transition of the holding member 50 to the first to fourth insertion/withdrawal allowing positions and the completely restraining position and the locking of the holding member 50 at each position, and successive insertion of the sub-housings 20A to 20D into the main housing 30 in the order of the sub-housings 20A, 20B, 20C and 20D can be alternately performed. In this way, the assembling of the sub-housings 20A to 20D into the main housing 30 and the holding of the sub-housings 20A to 20D are efficiently performed, with the result that mutual electrical connection of the high potential wire terminals 10H and mutual electrical connection of the low potential wire terminals 10L are achieved at once.

First, the holding member 50 is partially locked at the first insertion/withdrawal allowing position in the main housing 30 before the insertion of the sub-housings 20A to 20D. This partial locking is achieved by inserting the pair of housing restraining portions 54 of the holding member 50 into the pair of through holes 35*b* of the bottom wall 30*b* of the main housing 30 with the tips 54*a* of the housing restraining portions 54 in the lead, fitting the fitting projection 57 of the holding member 50 into the fitting recess 37 of the bottom wall 30*b*, and continuing the insertion and fitting up to a position where the first locked projection 58A at the uppermost position (most upstream position in the restraining portion insertion direction) on the fitting projection 57 is press-fit into the fitting recess 37 and move over the partial locking surfaces 38 on both sides of the fitting recess, i.e. up to the first insertion/withdrawal allowing position.

In this state, the both widthwise end parts of the first locked projection 58A are in contact with the partial locking surfaces 38 to suppress the withdrawal of the holding member 50 in the direction (downward direction in the reference orientation) opposite to the restraining portion insertion direction, whereby the holding member 50 is partially locked at the first insertion/withdrawal allowing position. Since the tips 54*a* of the pair of housing restraining portions 54 of the holding member 50 at this first insertion/withdrawal allowing position are located below the front and rear ribs 23F, 23R of the sub-housing 20A to be inserted in the lowermost stage of the main housing 30, the sub-housing 20A can be inserted into the main housing 30 along the housing insertion direction through the sub-housing insertion opening 32 to insert the front and rear ribs 23F, 23R into the positioning grooves 33 of the main housing 30. That is, the sub-housing 20A can be inserted into the main housing 30 while the holding member 50 is partially locked at the first insertion/withdrawal allowing position in the main housing 30. According to this insertion, the high and low potential wire terminals 10H, 10L held in the sub-housing 20A are respectively fit to the high and low potential connection terminals 44A, 44L in the lowermost stages of the high and low potential connection conductors 40H, 40L and electrically connectable to the high and low potential connection terminals 44A, 44L.

After the insertion of the sub-housing 20A is completed, the holding member 50 is transitioned from the first insertion/withdrawal allowing position to the second insertion/withdrawal allowing position and partially locked at the second insertion/withdrawal allowing position. These transition and partial locking are performed by operating the holding member 50 in the restraining portion insertion direction (upward direction in the reference orientation) and pushing the holding member 50 until the second locked projection 58B located right above the first locked projection 58A (located immediately upstream of the first locked projection 58A in the restraining portion insertion direction) moves over the partial locking surfaces 38.

In this state, the both widthwise end parts of the second locked projection 58B are in contact with the partial locking surfaces 38 to suppress the withdrawal of the holding member 50 in the direction (downward direction in the reference orientation) opposite to the restraining portion insertion direction, whereby the holding member 50 is partially locked at the second insertion/withdrawal allowing position. The pair of housing restraining portions 54 of the holding member 50 located at this second insertion/withdrawal allowing position cross the spaces between the front and rear ribs 23F, 23R of the sub-housing 20A already inserted in the lowermost stage of the main housing 30, thereby restraining the sub-housing 20A to impede movements of the front ribs 23F in the direction opposite to the housing insertion direction, i.e. the withdrawal of the sub-housing 20A from the main housing 30.

On the other hand, the housing restraining portions 54 allow the sub-housing 20B to be inserted thereabove while holding the sub-housing 20A since the tips 54*a* thereof are located below the front and rear ribs 23F, 23R of the sub-housing 20B to be inserted in the second stage from below. That is, the holding member 50 can allow the insertion of the sub-housing 20B while stably holding the sub-housing 20A. This facilitates an inserting operation of the sub-housing 20B.

Thereafter, (1) the movement from the second insertion/withdrawal allowing position to the third insertion/withdrawal allowing position and partial locking of the holding member 50, (2) the insertion of the sub-housing 20C, (3) the movement from the third insertion/withdrawal allowing position to the fourth insertion/withdrawal allowing position and partial locking of the holding member 50 and (4) the insertion of the sub-housing 20D are successively performed. In this way, the insertion of all the sub-housings 20A to 20D into the main housing 30 is completed. FIGS. 17 to 21 show a state before "(2) the insertion of the sub-housing 20C" is performed after "(1) the movement from the second insertion/withdrawal allowing position to the third insertion/withdrawal allowing position and partial locking of the holding member 50" is completed.

Full Locking of Holding Member in Main Housing

After all the sub-housings 20A to 20D are inserted into the main housing 30 as described above, the holding member 50 is further operated from the fourth insertion/withdrawal allowing position to the completely restraining position (i.e. the pair of housing restraining portions 54 are fully inserted) and fully locked at the completely restraining position. This full locking is performed by pushing the holding member 50 into the main housing 30 until the fully locked projection 59 in the lowermost stage (most downstream side in the restraining portion insertion direction) enters the fitting recess 37 of the main housing 30 and moves over the full locking surface 39 in the fitting recess 37.

In this state, i.e. in the state shown in FIGS. 1 to 4 and 21 to 25, the pair of housing restraining portions 54 of the holding member 50 at the completely restraining position are interposed between the front ribs 23F and the rear ribs 23R in all the sub-housings 20A to 20D, thereby restraining the sub-housings 20A to 20D to impede the withdrawal of all the sub-housings 20A to 20D. Thus, mutual connection of the high potential wire terminals 10H via the high potential connection conductor 40H and mutual connection of the low potential wire terminals 10L via the low potential connection conductor 40L are satisfactorily maintained.

In addition, since the sub-housings 20A to 20D are collectively restrained by the housing restraining portions 54 inserted into the main housing 30 to cross the sub-housings 20A to 20D, it is not necessary to provide each sub-housing with a large-scale withdrawal impeding structure such as a lock piece as before. This enables the miniaturization of the entire joint connector.

Further, the fully locked projection 59 of the holding member 50 comes into contact with the full locking surface 39 of the main housing 30 to suppress the withdrawal of the holding member 50 from the main housing 30 in the direction opposite to the restraining portion insertion direction (downward direction in the reference orientation), whereby the holding member 50 is fully locked at the completely restraining position. In this way, a state where the holding member 50 holds the respective sub-housings 20A to 20D is reliably maintained. In addition, the covering portion 56 of the holding member 50 at the completely restraining position covers the connection conductor insertion opening 34, whereby the high and low potential connection conductors 40H, 40L are effectively protected.

The invention is not limited to the embodiment described above. The present invention includes, for example, the following modes.

A) Concerning Sub-Housings

In the present invention, a specific number of the sub-housings is not limited. The housing stacking direction, in which the sub-housings are stacked, and the terminal arrangement direction need not necessarily be perpendicular to each other and the terminal arrangement direction may be, for example, oblique to the housing stacking direction. The positioning ribs (front and rear ribs 23F, 23R in the above embodiment) of each sub-housing can also omitted. However, if the positioning ribs are partially missing in the housing insertion direction and the housing restraining portions are inserted into these missing areas, the positioning ribs can be utilized as restrained portions. That is, both the positioning of the sub-housings in the main housing and the restraint of the sub-housings can be realized by a simple structure. Also in this case, the areas where the positioning ribs are missing are not limited to intermediate areas. For example, even if the positioning ribs are partially missing at the rear ends of the sub-housings (downstream ends in the housing insertion direction) and the housing restraining portions cross these areas, the withdrawal of the sub-housings can be effectively impeded.

B) Concerning High and Low Potential Connection Conductors

Specific shapes of the high and low potential connection conductors can be appropriately changed according to the number and arrangement of the wire terminals. For example, the high (or low) potential shorting portion and the plurality of high (or low) potential connection terminals may be formed by a single flat plate. However, if the high and low potential shorting portions 42H, 42L are arranged to extend parallel to each other on both outer sides of the fitting projection 57 and the high and low potential connection terminals 44H, 44L are respectively offset inwardly from the high and low potential shorting portions 42H, 42L like the high and low potential connection conductors 40H, 40L, the high and low potential connection terminals 44H, 44L can be fit to the high and low potential wire terminals 10H, 10L by narrowing the interval between the high and low potential connection terminals 44H, 44L to an interval equivalent to the interval between the high and low potential wire terminals 10H, 10L in the respective sub-housings 20A to 20D while ensuring the interval for accommodating the fitting projection 57 between the high and low potential shorting portions 42H, 42L.

The mounting of the high and low potential connection conductors into the main housing is also not limited to press-fitting through the connection conductor insertion opening 34. The high and low potential connection conductors may be integrally molded with the main housing. However, press-fitting through the connection conductor insertion opening 33 facilitates the mounting of the high and low potential connection conductors into the main housing. In addition, the high and low potential connection conductors 40H, 40L can be protected by a simple structure by providing the holding member 50 with the covering portion 56 for covering the connection conductor insertion opening 34 regardless of whether or not the main housing is open because of the connection conductor insertion opening 34.

C) Locking of Holding Member by Main Housing

The holding member only has to be locked by the main housing at least at the completely restraining position and the structure for partially locking the holding member at one or more insertion/withdrawal allowing positions may be omitted. However, it enables the insertion of the next sub-housing (e.g. sub-housing 20C in the state of FIGS. 17 to 21) while restraining the sub-housing(s) already inserted in the main housing (sub-housings 20A, 20B in the state of FIGS. 17 to 21) to have a plurality of insertion/withdrawal allowing positions (first to fourth insertion/withdrawal allowing positions in the above embodiment) arrayed along the restraining portion insertion direction such that the number of the sub-housings allowed to be withdrawn increases with distance from the completely restraining position, whereby the inserting operation of each sub-housing is facilitated.

Further, the structure for locking at the completely restraining position and the insertion/withdrawal allowing positions is also not limited to the one according to the above embodiment. For example, the main housing may be provided with a plurality of holding member locking portions corresponding to the completely restraining position and one or more insertion/withdrawal allowing positions. However, it enables a common locking portion (partial locking surfaces 38 in the above embodiment) provided in the main housing to lock each of the plurality of locked portions to provide the holding member with a plurality of locked portions (first to fourth locked projections 58A to 58D in the above embodiment) corresponding to a plurality of positions selected from the completely restraining position and one or more insertion/withdrawal allowing positions, whereby the structure of the main housing can be simplified. Particularly, it enables the simplification of the structure of a protecting member, effectively utilizing the covering portion to provide the plurality of locked portions on the back surface of the covering portion (surface of the fitting projection 57 formed on the back surface of the covering portion in the above embodiment).

As described above, a joint connector for connecting high potential wires and connecting low potential wires included in each of a plurality of twisted pair cables is provided which can be entirely miniaturized while facilitating the handling of each twisted pair cable and ensuring high product reliability.

Provided is a joint connector for connecting high potential wires and connecting low potential wires included in a plurality of twisted pair cables each including the high potential wire and the low potential wire, the joint connector including a plurality of high potential wire terminals to be mounted on the respective high potential wires, a plurality of low potential wires to be mounted on the respective low potential wires, a plurality of sub-housings respectively corresponding to the plurality of twisted pair cables, each sub-housing being configured to hold the high potential wire terminal and the low potential wire terminal of the corresponding twisted pair cable arranged in a specific terminal arrangement direction, a main housing having a sub-housing insertion opening open in a specific direction, the main housing being configured to accommodate the plurality of sub-housings in such an array that the plurality of sub-housings are stacked in a housing stacking direction intersecting the terminal arrangement direction by receiving the plurality of sub-housings inserted in a housing insertion direction parallel to an axial direction of the high potential wire terminals and the low potential wire terminals through the sub-housing insertion opening, a high potential connection conductor held in the main housing, the high potential connection conductor including a plurality of high potential connection terminals fittable to the plurality of high potential wire terminals respectively held in the plurality of sub-housings in a direction parallel to the housing insertion direction and a high potential shorting portion for shorting the plurality of high potential connection terminals to each other, the high potential connection conductor being configured to connect the plurality of high potential wire terminals to each other, a low potential connection conductor held in the main housing, the low potential connection conductor including a plurality of low potential connection terminals fittable to the plurality of low potential wire terminals respectively held in the plurality of sub-housings in a direction parallel to the housing insertion direction and a low potential shorting portion for shorting the plurality of low potential connection terminals to each other, the low potential connection conductor being configured to connect the plurality of low potential wire terminals to each other, and a holding member to be mounted into the main housing to hold each of the plurality of sub-housings inserted into the main housing. Each of the plurality of sub-housings includes a restrained portion. The holding member includes a housing restraining portion extending in a restraining portion insertion direction crossing the plurality of sub-housings stacked in the housing stacking direction, and the housing restraining portion restrains the restrained portions to impede the withdrawal of each sub-housing from the main housing in a direction opposite to the housing insertion direction by being inserted into the main housing along the restraining portion insertion direction with each of the plurality of sub-housings inserted in the main housing.

According to this joint connector, since the high potential wire terminals and the low potential wire terminals respectively mounted on the ends of the plurality of twisted pair cables are held in the sub-housings equipped for each of the plurality of twisted pair cables, a mounting operation of the high potential wires and the low potential wires into the sub-housings and the handling (maintenance and inspection) of each twisted pair cable are easy. By inserting the plurality of sub-housings into the common main housing in the housing insertion direction, the high potential wires can be collectively connected to each other and the low potential wires can be collectively connected to each other by respectively fitting the plurality of high potential wire terminals and the plurality of low potential wire terminals to the high potential connection terminals and the low potential connection terminals in the direction parallel to the housing insertion direction.

In addition, by inserting the housing restraining portion of the holding member into the main housing in the restraining portion insertion direction crossing the plurality of sub-housings, the respective restrained portions of the plurality of sub-housings can be simultaneously restrained (i.e. impedes the withdrawal of the respective sub-housings from the main housing in the direction opposite to the housing insertion direction) by the housing restraining portion. Thus, it is not necessary to provide each of the plurality of sub-housings with a complicated locking structure such as a lock piece as before or even if the lock structures are added, these can be simplified. This enables the miniaturization of the entire joint connector.

The main housing preferably includes a holding member locking portion configured to lock the holding member at least at one position including a completely restraining position where the housing restraining portion impedes the withdrawal of each of the plurality of sub-housings. The locking of the holding member by the holding member locking portion makes the holding of the respective sub-housings by the holding member more reliable.

The holding member locking portion preferably further locks the holding member at at least one insertion/withdrawal allowing position which is a position before the completely retaining position in the restraining portion insertion direction and where the housing restraining portion of the holding member allows the insertion and withdrawal of at least some of the plurality of sub-housings into and from the main housing along the housing insertion direction. This enables the insertion and withdrawal of at least some of the sub-housings into and from the main housing while locking the holding member to the main housing by the holding member locking portion.

Further, the at least one insertion/withdrawal allowing position more preferably includes a plurality of insertion/withdrawal allowing positions which are arranged along the restraining portion insertion direction such that the number of the sub-housings allowed to be withdrawn along the housing insertion direction, out of the plurality of sub-housing, increases with distance from the completely holding position. This enables the next sub-housing to be inserted into the main housing while causing the housing restraining portion to hold some of the sub-housings already inserted in the main housing by successively locking the holding member at each insertion/withdrawal allowing position by the holding member locking portion while inserting the housing restraining portion from the insertion/withdrawal allowing position most distant from the completely holding position out of the plurality of insertion/withdrawal allowing positions toward the completely holding position, or enables the respective sub-housings to be successively withdrawn from the main housing while causing the housing restraining portion to hold some of the sub-housings by successively locking the holding member at each insertion/withdrawal allowing position by the holding member locking portion while withdrawing the housing restraining portion in a direction opposite to the restraining portion insertion direction from the completely holding position. In this way, an operation of successively inserting or withdrawing the plurality of sub-housings into or from the main housing is possible.

Specifically, the holding member preferably includes a plurality of locked portions arranged in a direction parallel to the restraining portion insertion direction and the holding member locking portion preferably includes a common locking portion configured to lock the holding member at a plurality of positions selected from the completely holding position and the at least one insertion/withdrawal allowing position by being engaged with each of the plurality of locked portions. The plurality of locked portions enable the single common locking portion to lock the holding member at each of the plurality of positions (including some of the completely holding position and the plurality of insertion/withdrawal allowing positions), thereby enabling the structure of the main housing to be simplified.

The main housing preferably includes a connection conductor insertion opening open toward a side opposite to the sub-housing insertion opening and receives the high potential connection conductor and the low potential connection conductor inserted through the connection conductor insertion opening. This facilitates the mounting of the high and low potential connection conductors into the main housing. In this case, the holding member preferably further includes a covering portion configured to cover the connection conductor insertion opening with the holding member locked at the completely holding position. This can suppress an increase in the number of components of the entire joint connector by eliminating a need for preparing a dedicated lid member for covering the connection conductor insertion opening.

The plurality of locked portions can also be provided on a back surface of the covering portion. In this way, the holding member can be provided with the plurality of locked portions, utilizing the covering portion, without complicating and enlarging the structure of the holding member.

Further, it is also possible to respectively provide the covering portion and the main housing with fitting portions configured to determine a relative position of the holding member with respect to the main housing in the terminal arrangement direction and the housing insertion direction while allowing a relative movement of the holding member with respect to the main housing in the restraining portion insertion direction by fitting to each other. The fitting portions enable an insertion posture of the housing restraining portion of the holding member to be stabilized with respect to the main housing, effectively utilizing the cover.

In this case, preferably, the high potential connection conductor and the low potential connection conductor are arranged such that the high potential shorting portion and the low potential shorting portion extend in parallel to each other on both outer sides of the fitting portions, and the high potential connection terminals and the low potential connection terminals are respectively offset inwardly from the high potential shorting portion and the low potential shorting portion. This arrangement enables the high and low potential connection conductors to be fit to the high potential wire terminals and the low potential wire terminals adjacent to each other (mounted on the respective twisted pair cables) by narrowing an interval between the high potential connection conductor and the low potential connection conductor while securing a space for the fitting portions between the high potential shorting portion and the low potential shorting portion.

Preferably, each of the plurality of sub-housings has a pair of side surfaces facing in the terminal arrangement direction and includes positioning ribs projecting further outward than other parts on the side surfaces and extending along the housing insertion direction, and the main housing includes positioning grooves configured to determine the positions of the sub-housings in the housing stacking direction by receiving the inserted positioning ribs. A combination of the positioning ribs and the positioning grooves enables the positions of the respective sub-housings to be stabilized in the housing stacking direction even without interposing partition walls between adjacent ones of the sub-housings. In this way, a dimension of the main housing can be reduced by suppressing an interval between the sub-housings in the housing stacking direction.

In this case, the positioning ribs are shaped to be partially missing in the housing insertion direction and can function as the restrained portions to be restrained by the housing restraining portion by receiving the housing restraining portion inserted into a missing area of the positioning ribs.

Preferably, each of the plurality of sub-housings includes a pair of housing constituting members separable in a housing separation direction parallel to the housing stacking direction and holds the high potential wire terminal and the low potential wire terminal by sandwiching the high potential wire terminal and the low potential wire terminal in the housing separation direction by the pair of housing constituting members. This structure facilitates the mounting of each wire terminal into each sub-housing. In addition, by inserting the plurality of sub-housings into the main housing and restraining the sub-housings in the housing stacking direction, the separation of the pair of housing constituting members in the housing separation direction parallel to the housing stacking direction is restricted and the high and low potential wire terminals can be reliably held by the sub-housing regardless of the division of the sub-housing into the housing constituting members.

The invention claimed is:

1. A joint connector for connecting high potential wires and connecting low potential wires included in twisted pair cables each including the high potential wire and the low potential wire, comprising:

high potential wire terminals to be mounted on the respective high potential wires;

low potential wire terminals to be mounted on the respective low potential wires;

sub-housings respectively corresponding to the twisted pair cables, each sub-housing being configured to hold the high potential wire terminal and the low potential wire terminal of the corresponding twisted pair cable arranged in a specific terminal arrangement direction;

a main housing including a sub-housing insertion opening open in a specific direction, the main housing being configured to accommodate the sub-housings in such an array that the sub-housings are stacked in a housing stacking direction intersecting the terminal arrangement direction by receiving the sub-housings inserted in a housing insertion direction parallel to an axial direction of the high potential wire terminals and the low potential wire terminals through the sub-housing insertion opening;

a high potential connection conductor held in the main housing, the high potential connection conductor including high potential connection terminals fittable to the high potential wire terminals respectively held in the sub-housings in a direction parallel to the housing insertion direction and a high potential shorting portion for shorting the high potential connection terminals to each other, the high potential connection conductor being configured to connect the high potential wire terminals to each other;

a low potential connection conductor held in the main housing, the low potential connection conductor including low potential connection terminals fittable to the low potential wire terminals respectively held in the sub-housings in a direction parallel to the housing insertion direction and a low potential shorting portion for shorting the low potential connection terminals to each other, the low potential connection conductor being configured to connect the low potential wire terminals to each other; and a holding member to be mounted into the main housing to hold each of the sub-housings inserted into the main housing;

each of the sub-housings including a restrained portion; and the holding member including a housing restraining portion extending in a restraining portion insertion direction crossing the sub-housings stacked in the housing stacking direction, the housing restraining portion restraining the restrained portions to impede the withdrawal of each sub-housing from the main housing in a direction opposite to the housing insertion direction by being inserted into the main housing along the restraining portion insertion direction with each of the sub-housings inserted in the main housing.

2. The joint connector of claim 1, wherein the main housing includes a holding member locking portion configured to lock the holding member at least at one position including a completely restraining position where the housing restraining portion impedes the withdrawal of each of the sub-housings.

3. The joint connector claim 2, wherein the holding member locking portion further locks the holding member at least at one insertion/withdrawal allowing position disposed before the completely holding position in the restraining portion insertion direction and where the housing restraining portion of the holding member allows the insertion and withdrawal of at least some of the plurality of sub-housings into and from the main housing along the housing insertion direction.

4. The joint connector of claim 3, wherein the at least one insertion/withdrawal allowing position includes plurality insertion/withdrawal allowing positions arranged along the restraining portion insertion direction such that the number of the sub-housings allowed to be withdrawn along the housing insertion direction increases with distance from the completely holding position.

5. The joint connector of claim 3, wherein the holding member includes locked portions arranged in a direction parallel to the restraining portion insertion direction, and the holding member locking portion includes a common locking portion configured to lock the holding member positions selected from the completely holding position and the at least one insertion/withdrawal allowing position by being engaged with each of the locked portions.

6. The joint connector of claim 2, wherein the main housing includes a connection conductor insertion opening open toward a side opposite to the sub-housing insertion opening and receives the high potential connection conductor and the low potential connection conductor inserted through the connection conductor insertion opening, and the holding member further includes a covering portion configured to cover the connection conductor insertion opening with the holding member locked at the complete holding position.

7. The joint connector of claim 6, wherein the holding member locking portion further locks the holding member at least at one insertion/withdrawal allowing position disposed before the completely holding position in the restraining portion insertion direction, and where the housing restraining portion of the holding member allows the insertion and withdrawal of at least some of the plurality of sub-housings into and from the main housing along the housing insertion direction, the holding member includes locked portions arranged in a direction parallel to the restraining portion insertion direction, the holding member locking portion includes a common locking portion configured to lock the holding member at a plurality of positions selected from the completely holding position and the at least one insertion/withdrawal allowing position by being engaged with each of the locked portions, and the locked portions are provided on a back surface of the covering portion.

8. The joint connector claim 6, wherein the cover and the main housing include fitting portions configured to determine a relative position of the holding member with respect to the main housing in the terminal arrangement direction and the housing insertion direction while allowing a relative movement of the holding member with respect to the main housing in the restraining portion insertion direction by fitting to each other.

9. The joint connector of claim 8, wherein the high potential connection conductor and the low potential connection conductor are arranged such that the high potential shorting portion and the low potential shorting portion extend in parallel to each other on both outer sides of the fitting portions, and the high potential connection terminals and the low potential connection terminals are respectively offset inwardly from the high potential shorting portion and the low potential shorting portion.

10. The joint connector of claim 1, wherein each of the sub-housings has two side surfaces facing in the terminal arrangement direction and includes positioning ribs projecting farther out than other parts on the side surfaces and extending along the housing insertion direction, and the main housing includes positioning grooves configured to determine the positions of the sub-housings in the housing stacking direction by receiving the inserted positioning ribs.

11. The joint connector of claim 10, wherein the positioning ribs are shaped to be partially missing in the housing insertion direction and function as the restrained portions to be restrained by the housing restraining portion by receiving the housing restraining portion inserted into an missing area of the positioning ribs.

12. The joint connector of claim 1, wherein each of the sub-housings includes two housing constituting members separable in a housing separation direction parallel to the housing stacking direction and holds the high potential wire terminal and the low potential wire terminal by sandwiching the high potential wire terminal and the low potential wire terminal in the housing separation direction by the housing constituting members.

* * * * *